US007963577B2

(12) United States Patent
Wolf

(10) Patent No.: US 7,963,577 B2
(45) Date of Patent: Jun. 21, 2011

(54) INTEGRATED LOCK AND TILT-LATCH MECHANISM FOR A SLIDING WINDOW

(75) Inventor: Glen Wolf, Owatonna, MN (US)

(73) Assignee: Truth Hardware Corporation, Owatonna, MN (US)

( * ) Notice: Subject to any disclaimer, the term of this patent is extended or adjusted under 35 U.S.C. 154(b) by 691 days.

(21) Appl. No.: 11/861,045

(22) Filed: Sep. 25, 2007

(65) Prior Publication Data

US 2009/0079202 A1 Mar. 26, 2009

(51) Int. Cl.
*E05C 3/04* (2006.01)
*E05C 3/00* (2006.01)

(52) U.S. Cl. ..... 292/241; 292/DIG. 20; 292/DIG. 47

(58) Field of Classification Search ..... 292/241, 292/DIG. 20, DIG. 47
See application file for complete search history.

(56) References Cited

U.S. PATENT DOCUMENTS

| | | | |
|---|---|---|---|
| 49,592 | A | 8/1865 | Richards |
| 166,842 | A | 8/1875 | Berryman |
| 201,146 | A | 3/1878 | Adler |
| 336,302 | A | 2/1886 | Dudgeon |
| 374,391 | A | 12/1887 | Born |
| 403,847 | A | 5/1889 | Langenback |
| 480,148 | A | 8/1892 | Theby |
| 540,911 | A | 6/1895 | George |
| 543,226 | A | 7/1895 | Atwood |
| 784,446 | A | 3/1905 | Taylor et al. |
| 878,206 | A | 2/1908 | Johnson |
| 907,525 | A | 12/1908 | Rapson |
| 912,378 | A | 2/1909 | Jackson |
| 1,041,803 | A | 10/1912 | Kilburn |
| 1,059,999 | A | 4/1913 | James |
| 1,253,810 | A | 1/1918 | Gianninoto |
| 1,393,628 | A | 10/1921 | Leichter |
| 1,516,628 | A | 11/1924 | Blackwell |
| 1,550,532 | A | 8/1925 | French |
| 1,704,946 | A | 3/1929 | Lindgren |
| 1,724,116 | A | 8/1929 | Swearengin |
| 1,901,974 | A | 3/1933 | Macy |
| 2,055,289 | A | 9/1936 | Hanan |
| 2,309,437 | A | 1/1943 | Blodgett |
| 2,500,849 | A | 3/1950 | Menns |
| 2,537,736 | A | 1/1951 | Carlson |
| 2,768,852 | A | 10/1956 | Hicks |

(Continued)

FOREIGN PATENT DOCUMENTS

| | | |
|---|---|---|
| CA | 2 210 026 | 1/2002 |

(Continued)

OTHER PUBLICATIONS

U.S. Appl. No. 10/959,696, filed May 12, 2005, Marshik.

*Primary Examiner* — Carlos Lugo
(74) *Attorney, Agent, or Firm* — Patterson Thuente Christensen Pedersen, P.A.

(57) ABSTRACT

An integrated lock and tilt-latch mechanism for a sliding window including an actuator assembly operably connected by a flexible linking member to at least one tilt-latch mechanism adapted for mounting in a window sash. The actuator assembly includes a control lever that rotates a sweep cam and a selectively rotates a spool, thereby locking or unlocking the sliding window or actuating the tilt-latch mechanism. At least one biasing member causes the control lever to favor locked or unlocked positions over intermediate and tilt positions.

15 Claims, 31 Drawing Sheets

U.S. PATENT DOCUMENTS

| | | | |
|---|---|---|---|
| 2,934,370 | A | 4/1960 | Love et al. |
| 3,027,188 | A | 3/1962 | Eichstadt |
| 3,122,797 | A | 3/1964 | Segre |
| 3,125,366 | A | 3/1964 | Cetrone et al. |
| 3,438,153 | A | 4/1969 | Di Lemme |
| 3,683,652 | A | 8/1972 | Halopoff et al. |
| 3,811,718 | A | 5/1974 | Bates |
| 3,994,093 | A | 11/1976 | Mayer et al. |
| 4,061,370 | A | 12/1977 | Hauber |
| 4,199,176 | A | 4/1980 | Kelly |
| 4,227,345 | A | 10/1980 | Durham, Jr. |
| 4,303,264 | A | 12/1981 | Uehara |
| 4,305,612 | A | 12/1981 | Hunt et al. |
| D268,643 | S | 4/1983 | Anderson |
| 4,478,444 | A | 10/1984 | Kurz et al. |
| 4,502,716 | A | 3/1985 | Tsai |
| 4,578,903 | A | 4/1986 | Simpson |
| 4,818,000 | A | 4/1989 | Bobrowski |
| 4,901,475 | A | 2/1990 | Simpson |
| 4,961,286 | A | 10/1990 | Bezubic |
| 5,072,464 | A | 12/1991 | Draheim et al. |
| 5,076,015 | A | 12/1991 | Manzalini |
| 5,087,088 | A | 2/1992 | Milam |
| 5,090,750 | A | 2/1992 | Lindqvist |
| 5,096,240 | A | 3/1992 | Schultz |
| 5,104,165 | A | 4/1992 | Anderson et al. |
| 5,110,165 | A | 5/1992 | Piltingsrud |
| 5,121,951 | A | 6/1992 | Harbom et al. |
| 5,127,192 | A | 7/1992 | Cross |
| 5,127,685 | A | 7/1992 | Dallaire et al. |
| 5,139,291 | A | 8/1992 | Schultz |
| 5,152,103 | A | 10/1992 | Tucker et al. |
| 5,159,782 | A | 11/1992 | Sales |
| 5,165,737 | A | 11/1992 | Riegelman |
| 5,168,665 | A | 12/1992 | Goldenberg |
| 5,248,174 | A | 9/1993 | Matz et al. |
| 5,251,401 | A | 10/1993 | Prete et al. |
| 5,301,989 | A | 4/1994 | Dallmann et al. |
| 5,371,971 | A | 12/1994 | Prete |
| 5,398,447 | A | 3/1995 | Morse |
| RE35,463 | E | 2/1997 | Vetter et al. |
| 5,669,639 | A | 9/1997 | Lawrence |
| 5,791,700 | A | 8/1998 | Biro |
| 5,992,907 | A | 11/1999 | Sheldon et al. |
| 6,347,820 | B2 | 2/2002 | Subliskey |
| 6,485,070 | B1 | 11/2002 | Schultz |
| RE37,916 | E | 12/2002 | Szapucki et al. |
| 6,588,150 | B1 | 7/2003 | Wong et al. |
| 6,607,221 | B1 | 8/2003 | Elliott |
| 6,817,142 | B2 | 11/2004 | Marshik |
| 6,877,784 | B2 | 4/2005 | Kelley et al. |
| 7,013,603 | B2 | 3/2006 | Eenigenburg et al. |
| 7,070,211 | B2 | 7/2006 | Polowinczak et al. |
| 7,322,619 | B2 | 1/2008 | Nolte et al. |
| 2007/0029810 | A1 | 2/2007 | Nolte et al. |

FOREIGN PATENT DOCUMENTS

| | | | |
|---|---|---|---|
| GB | 2 026 594 | A | 2/1980 |
| GB | 2 028 415 | A | 3/1980 |
| GB | 2 156 896 | A | 10/1985 |

INTEGRATED LOCK AND TILT-LATCH MECHANISM FOR A SLIDING WINDOW

FIELD OF THE INVENTION

This invention relates to window locks, and more particularly to window locks for sliding windows.

BACKGROUND OF THE INVENTION

Double-hung and single hung sliding windows include two window sashes typically mounted for vertical movement along adjacent parallel tracks in a window frame. Traditional double-hung window designs provide poor washability, because it is difficult for a person located inside a structure in which the window is installed to wash the outside of the window pane. To fully wash the outer surface of such windows (which outer surface is the one which is most often in need of cleaning), the person cleaning the window must typically go outside the dwelling. This is not only extremely inconvenient, as the person has to walk significant distances merely to wash both sides of a single window, but it can also force a window washer, when trying to wash double and single-hung windows located at significant heights, to face the undesirable choice of either risking injury by climbing to that height or doing a relatively poor job of washing by merely reaching from a distance with a hose or a special long pole apparatus of some type. Such cleaning is still further complicated where there are screens or storm windows that must be removed prior to washing.

To overcome this problem, windows of this type have been developed that enables one or more of the sashes to be tilted inwardly to gain access to the outside surface of the window pane from within the structure. Various types of latching mechanisms have been developed to enable the latch to secure the sash in place in the frame, but also enable tilting the sash by operating the latches. A common arrangement has such latches positioned in opposite ends of a top horizontal rail of the upper and/or lower sash, with each latch typically including a bolt end or plunger which during normal operation extends out from the side of the sash into the sash track in the window frame to guide the sash for typical vertical movement. When washing is desired, a bolt end or plunger of each latch is retracted to free the top rail of the sash from the track so that the sash may be suitably pivoted inwardly about pivots guiding the bottom rail of the sash in the track and thereby allow the washer to easily reach the outside surface of the window pane of that sash.

The bolt end or plunger in many of the prior art latches is usually biased outwardly into the track by a spring structure or the like, with the bolt end retracted inwardly by the washer manually pulling the bolt ends in toward the center of the top rail against the force of the spring as, for example, in the mechanism disclosed in U.S. Pat. No. 5,139,291. A drawback of such mechanisms, however, is that both latches must be operated simultaneously, requiring that the operator use both hands. Moreover, simultaneous operation of latch controls spaced at the far edges of the sash can be awkward, especially for wide windows. Another mechanism, disclosed in U.S. Pat. No. 5,992,907, commonly owned by the owners of the present invention and hereby fully incorporated herein by reference, has a lever operably coupled with a check rail lock assembly that simultaneously operates remotely located tilt-latch assemblies.

Other mechanisms linking tilt latches with a single control that also locks the sashes together are well known. For example, U.S. Pat. No. 5,398,447 (the '447 patent) discloses a tilt-lock latch mechanism wherein a lever positioned proximate the center of the top rail of a lower sash may be rotated in one direction to engage a keeper positioned on the upper sash proximate the lever or in the opposite direction to operate remotely located tilt latches to enable tilting of the lower sash for cleaning. U.S. Pat. No. 5,791,700 (the '700 patent) discloses a tilt lock latch mechanism wherein a single control lever operates both sash locks and remote tilt latches. To accomplish this, the control lever is selectively rotatably positionable in three discrete positions: (1) a first position wherein the sash locks and the tilt latches are engaged; (2) a second position wherein the sash locks are disengaged to enable sliding of the sashes but the tilt latches are still engaged; and (3) a third position wherein the sash locks and the tilt latches are disengaged to enable sliding of the window. Similarly, U.S. Pat. No. 6,817,142 (the '142 patent) and its continuation U.S. application Ser. No. 10/959,696 also disclose a tilt-lock latch mechanism having such a three-position control lever.

Each of the above described mechanisms, however, has certain drawbacks. The '447 patent mechanism, while generally simple, requires rotation of the control lever in opposite directions from a center position for unlocking and tilting. This is inconvenient and may result in unintended tilting operation of the window if an inexperienced user seeking merely to unlock the window rotates the lever in the wrong direction. Also, the '447 patent mechanism requires that a separate control be manipulated by the operator to maintain the control lever in a desired position. The '700 patent mechanism, while enabling same-direction rotation of the control lever, is relatively complex, and may be expensive to manufacture and difficult to install and adjust. The '142 patent mechanism may be difficult to adjust, requiring partial disassembly and manipulation of a screw on the tilt latches for tensioning the strap connecting the control lever with the tilt latches. Moreover, the '142 patent describes a separate button that must be manipulated for engaging or releasing the tilt latches. This may be confusing for a user and result in frustration when attempting to tilt the window for cleaning, or in failure to properly reengage the tilt latches when cleaning is complete.

Another mechanism, described in U.S. Pat. No. 6,877,784, includes a rotary lever with sash lock that actuates remote tilt latches through an extensible member. A drawback of this mechanism, however, is that it is relatively complex, including a spring-loaded control lever and a pivoting trigger release mechanism in each of the tilt latches, making it relatively more expensive to produce and reducing reliability. Further, there are no simple means provided for attaching the extensible member to the tilt latches, nor is any means for adjusting length and tension of the extensible member provided.

U.S. patent application Ser. No. 10/289,803 discloses a similar tilt lock latch mechanism including a three-position control lever that actuates a sash lock as well as remotely located tilt latches. One drawback of this mechanism, however, is that a relatively complicated fastener arrangement is used for connecting the actuator spool to the tilt latch connector, affecting cost of manufacture and usability of the mechanism. Also, the tilt latches are not equipped with any mechanism for holding the latches in the retracted position. When the window is tilted into position after cleaning, the protruding latch-bolts may mar the window frame if the operator forgets to manually retract them. Moreover, a separate button is described that must be manipulated for engaging or releasing the tilt latches, thus complicating operation.

U.S. patent application Ser. No. 11/340,428 also discloses a similar tilt lock latch mechanism including a three-position control lever that actuates a sash lock as well as remotely located tilt latches. One drawback of this mechanism, however, is that the lever may remain in the window-tilt position unless an operator manually returns the lever to the locked or unlocked positions. Also, the lever may remain in an intermediate position unless an operator specifically positions the lever to a tilt, locked, or unlocked position. Moreover, it may be difficult for an operator to judge when the lever has been correctly positioned to a tilt, locked, or unlocked position.

What is still needed is a low-cost combination tilt-lock-latch mechanism for a double-hung window that is easy to install and adjust, simple to use, and is biased toward a locked or unlocked position.

SUMMARY OF THE INVENTION

The present invention addresses the need for a low-cost combination tilt-lock-latch mechanism for a sliding window that combines ease of installation and adjustment, simplicity of use, and a bias toward a locked or unlocked position. In embodiments of the invention, an integrated lock and tilt-latch mechanism for a sliding window includes at least one tilt-latch mechanism adapted for mounting in the window sash. The tilt-latch mechanism includes a housing presenting a longitudinal axis and having an aperture defined in a first end thereof, a plunger having a latch-bolt portion, a plunger-latch member, and first and second biasing members. The plunger is disposed in the housing and is selectively slidably shiftable along the longitudinal axis of the housing between an extended position in which the latch-bolt portion of the plunger projects through the aperture in the housing to engage the window frame so as to prevent tilting of the sash, and a retracted position in which the latch-bolt portion of the plunger is substantially within the housing to enable tilting of the sash. The first biasing member is arranged so as to bias the plunger toward the extended position. The plunger-latch member is operably coupled with the tilt-latch housing and is arranged so as to be selectively slidably shiftable in a direction transverse to the longitudinal axis when the plunger is in the retracted position. The plunger-latch member is shiftable between a first position in which the plunger-latch member engages and prevents shifting of the plunger and a second position in which the plunger-latch member enables shifting of the plunger. The second biasing member is arranged so as to bias the plunger-latch member toward the first position so that when the plunger is retracted, the plunger-latch automatically shifts to retain the plunger in the retracted position. The plunger-latch may include a trigger portion arranged so that when the sash is tilted into position in the frame, the trigger portion contacts the window frame or second sash, shifting the plunger-latch so as to release the plunger. The mechanism further includes an actuator mechanism adapted for mounting on the sash. The actuator mechanism includes a housing, a control on the housing, a lock member, and a tilt-latch actuator member. The lock member and the tilt-latch actuator member are operably coupled with the control. A linking member operably couples the tilt-latch actuator member and the plunger of the tilt-latch mechanism. The control lever is selectively positionable between at least three positions, including a locked position in which the sweep cam is positioned so that a portion of the sweep cam extends under the locking tab of a keeper, an unlocked position in which the sweep cam is substantially retracted from the locking tab of a keeper, and a tilt position in which the sweep cam is retracted and the plunger of the tilt-latch mechanism is positioned in the retracted position.

In another embodiment of the invention, an integrated lock and tilt-latch mechanism for a sliding window having a frame with at least one sliding sash therein, the sash also tiltably positionable relative to the frame, includes an actuator assembly, at least one tilt-latch assembly adapted for mounting on the sash, and a flexible linking member. The actuator assembly includes a housing, a control lever, a lock member, and a tilt-latch actuator member. The lock member and the tilt-latch actuator member are operably coupled with the control, and the tilt-latch actuator has structure for receiving and applying tension to the flexible linking member. The at least one tilt-latch assembly includes a tilt-latch housing presenting a longitudinal axis and having an aperture defined in a first end thereof. A plunger is disposed in the tilt-latch housing, the plunger having a latch-bolt portion and being selectively slidably shiftable along the longitudinal axis between an extended position in which the latch-bolt portion of the plunger projects through the aperture and a retracted position in which the latch-bolt portion of the plunger is substantially within the tilt-latch housing. The plunger defines a channel for receiving the flexible linking member and has a locking member positioned proximate the channel. The locking member is selectively shiftably adjustable from a location outside the tilt-latch housing between a first position in which the flexible linking member is freely slidable in the channel to enable insertion and removal of the flexible linking member, and a second position in which the locking member is engaged with the flexible linking member to fixedly secure the flexible linking member in the channel, thereby operably coupling the tilt-latch actuator with the plunger of the tilt-latch. In a further embodiment of the invention, a window includes a frame and a first sash and a second sash, each slidable in the frame. The first sash is also tiltably positionable relative to the frame. An integrated lock and tilt-latch mechanism is positioned on the first sash, including an actuator mechanism, at least one tilt-latch adapted for mounting on the sash, and a flexible linking member. The actuator mechanism includes a housing, a control, a lock member, and a tilt-latch actuator member. The lock member and the tilt-latch actuator member are operably coupled with the control. The tilt-latch actuator has structure for receiving and applying tension to the flexible linking member. The at least one tilt-latch includes a tilt-latch housing presenting a longitudinal axis and having an aperture defined in a first end thereof, and a plunger disposed in the tilt-latch housing. The plunger has a latch-bolt portion and is selectively slidably shiftable along the longitudinal axis between an extended position in which the latch-bolt portion of the plunger projects through the aperture and a retracted position in which the latch-bolt portion of the plunger is substantially within the tilt-latch housing. The plunger defines a channel for receiving the flexible linking member and has a locking member positioned proximate the channel. The locking member is selectively shiftably adjustable, from a location outside the tilt-latch housing, between a first position in which the flexible linking member is freely slidable in the channel to enable insertion and removal of the flexible linking member, and a second position in which the locking member is engaged with the flexible linking member to fixedly secure the flexible linking member in the channel, thereby operably coupling the tilt-latch actuator with the plunger of the tilt-latch. The control is selectively positionable between at least three positions, including a locked position in which the lock member is positioned so that a portion of the lock member extends from the housing of the actuator mechanism, an unlocked position in which the lock member is positioned substantially within the housing of the actuator mechanism, and a tilt position in which the lock member is positioned substantially within the housing of the actuator mechanism and the plunger of the tilt-latch mechanism is positioned in the retracted position.

In yet another embodiment of the invention, a window includes a frame and a first and a second sash, each sash slidable in the frame, wherein the first sash is also tiltably positionable relative to the frame. An integrated lock and tilt-latch mechanism is positioned on the first sash, the mechanism including at least one tilt-latch mechanism having a housing presenting a longitudinal axis, a plunger having a latch-bolt portion, a plunger-latch member, and first and second biasing members. The plunger is disposed in the housing and is selectively slidably shiftable along the longitudinal axis between an extended position in which the latch-bolt portion of the plunger engages the frame of the window to prevent tilting of the first sash and a retracted position in which the latch-bolt portion of the plunger is substantially within the housing to enable tilting of the first sash. The first biasing member is arranged so as to bias the plunger toward the extended position. The plunger-latch member is operably coupled with the housing and arranged so as to be selectively slidably shiftable in a direction transverse to the longitudinal axis when the plunger is in the retracted position. The plunger-latch member is shiftable between a first position in which the plunger-latch member engages and prevents shifting of the plunger and a second position in which the plunger-latch member enables shifting of the plunger. The second biasing member is arranged so as to bias the plunger-latch member toward the first position. The mechanism further includes an actuator mechanism including a housing, a control on the housing, a lock member, and a tilt-latch actuator member. The lock member and the tilt-latch actuator member are operably coupled to the control with a linking member operably coupling the tilt-latch actuator member and the plunger of the at least one tilt-latch mechanism. The control is selectively positionable among at least three positions, including a locked position in which a sweep cam is engaged with a keeper of the second sash to prevent relative sliding movement of the first and second sashes, an unlocked position in which the lock member is free from the keeper of the second sash, and a tilt position in which the lock member is free from the keeper of the second sash and the plunger of the tilt-latch mechanism is positioned in the retracted position to enable tilting of the first sash.

In another embodiment, the control lever is biased toward a locked position or an unlocked position. The sweep cam of the control lever is selectively shiftably adjustable from between a first position in which the flexible linking member is freely slidable in the channel to enable insertion and removal of the flexible linking member, and a second position in which the locking member is engaged with the flexible linking member to fixedly secure the flexible linking member in the channel, thereby operably coupling the tilt-latch actuator with the plunger of the tilt-latch. The control lever is selectively positionable between at least three positions including a locked position in which the sweep cam engages a keeper, an unlocked position in which the sweep cam is disengaged from the keeper, and a tilt position in which the sweep cam is disengaged from the keeper and the plunger of the tilt-latch mechanism is positioned in the retracted position. Depending upon the position of the control lever, the control member is biased toward the locked position or the unlocked position. In the tilt position and intermediate the tilt position and the unlocked position, the control is biased toward the unlocked position. Intermediate the unlocked position and the locked position, the control is biased toward the unlocked position or the locked position, dependent on which position the control is most proximate.

DETAILED DESCRIPTION OF THE PREFERRED EMBODIMENTS

Figure 1:
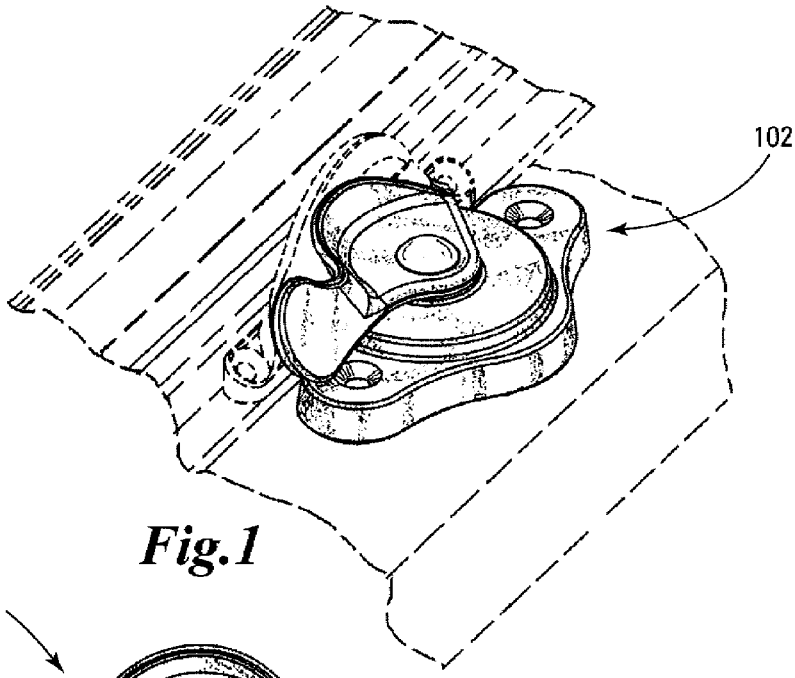
FIG. 1 is a perspective view of an actuator assembly in a locked position according to an embodiment of the present invention.
Figure 2:
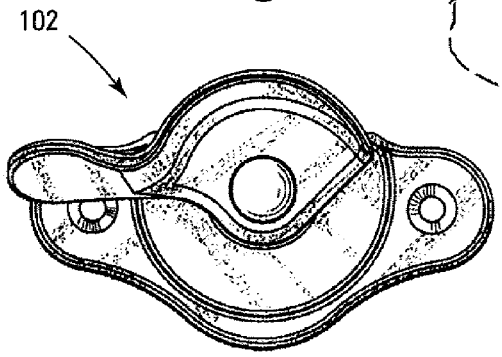
FIG. 2 is a top view of an actuator assembly in a locked position according to an embodiment of the present invention.
Figure 3:
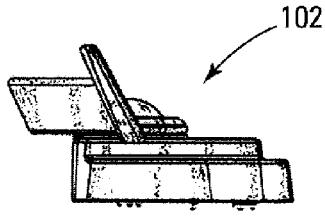
FIG. 3 is a side view of an actuator assembly in a locked position according to an embodiment of the present invention.
Figure 4:
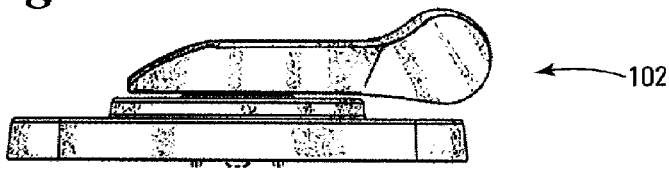
FIG. 4 for a rear view of an actuator assembly in a locked position according to an embodiment of the present invention.
Figure 5:
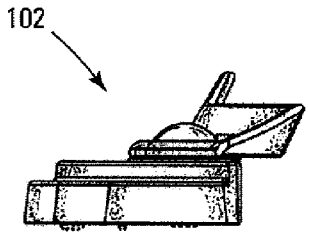
FIG. 5 is a side view of an actuator assembly in a locked position according to an embodiment of the present invention.
Figure 6:
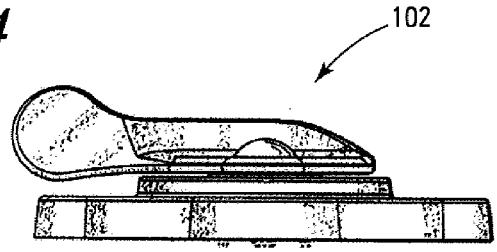
FIG. 6 is a front view of an actuator assembly in a locked position according to an embodiment of the present invention.
Figure 7:
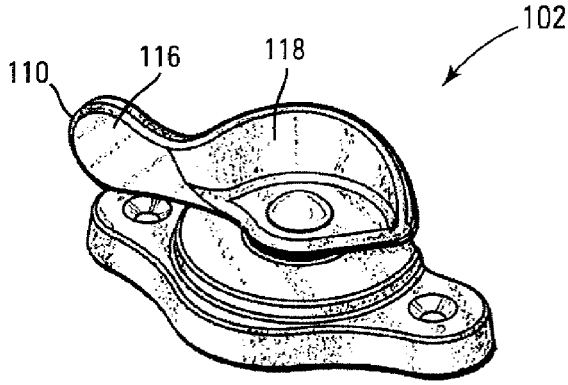
FIG. 7 is a perspective view of an actuator assembly in a locked position according to an embodiment of the present invention.
Figure 8:
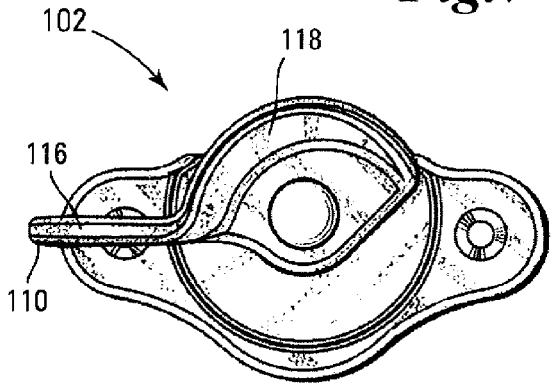
FIG. 8 is a top view of an actuator assembly in a locked position according to an embodiment of the present invention.
Figure 9:
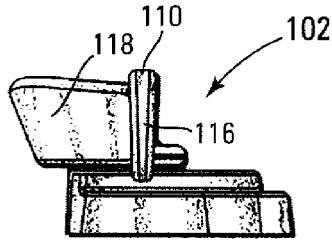
FIG. 9 is a side view of an actuator assembly in a locked position according to an embodiment of the present invention.
Figure 10:
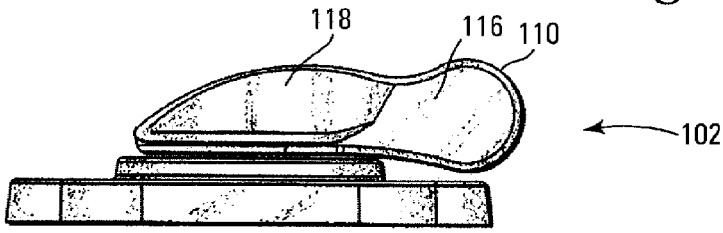
FIG. 10 is a rear view of an actuator assembly in a locked position according to an embodiment of the present invention.
Figure 11:
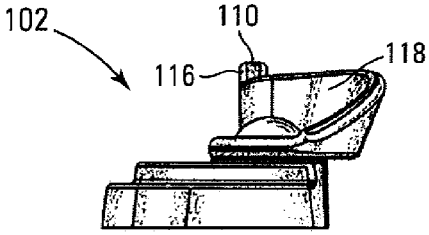
FIG. 11 is a side view of an actuator assembly in a locked position according to an embodiment of the present invention.
Figure 12:
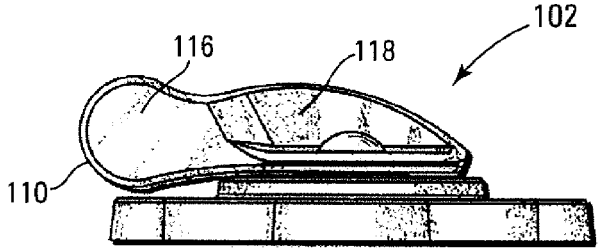
FIG. 12 is a front view of an actuator assembly in a locked position according to an embodiment of the present invention.
Figure 13:
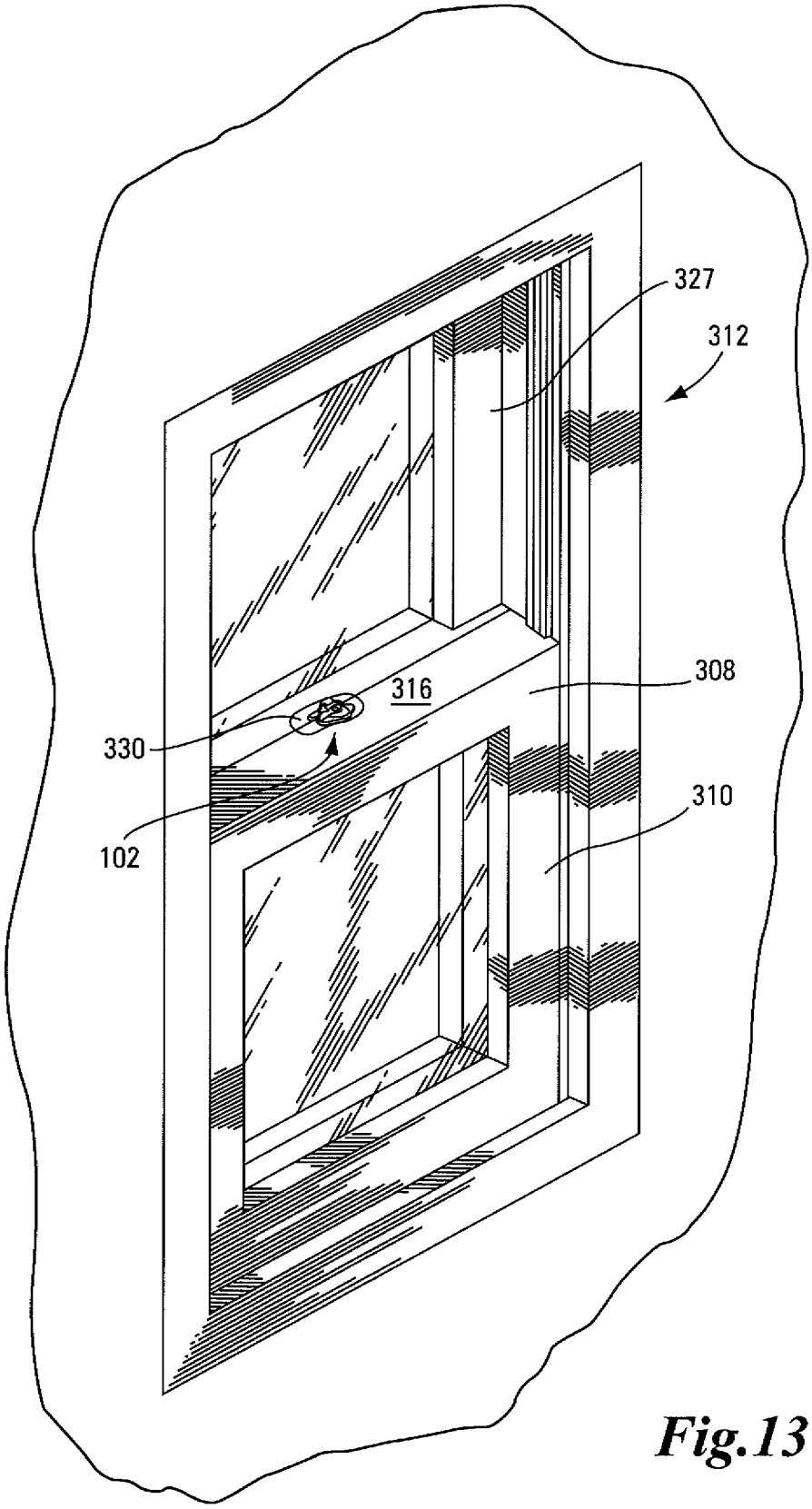
FIG. 13 is a perspective view of a double-hung window with an integrated lock and tilt-latch assembly according to an embodiment of the present invention.
Figure 14:
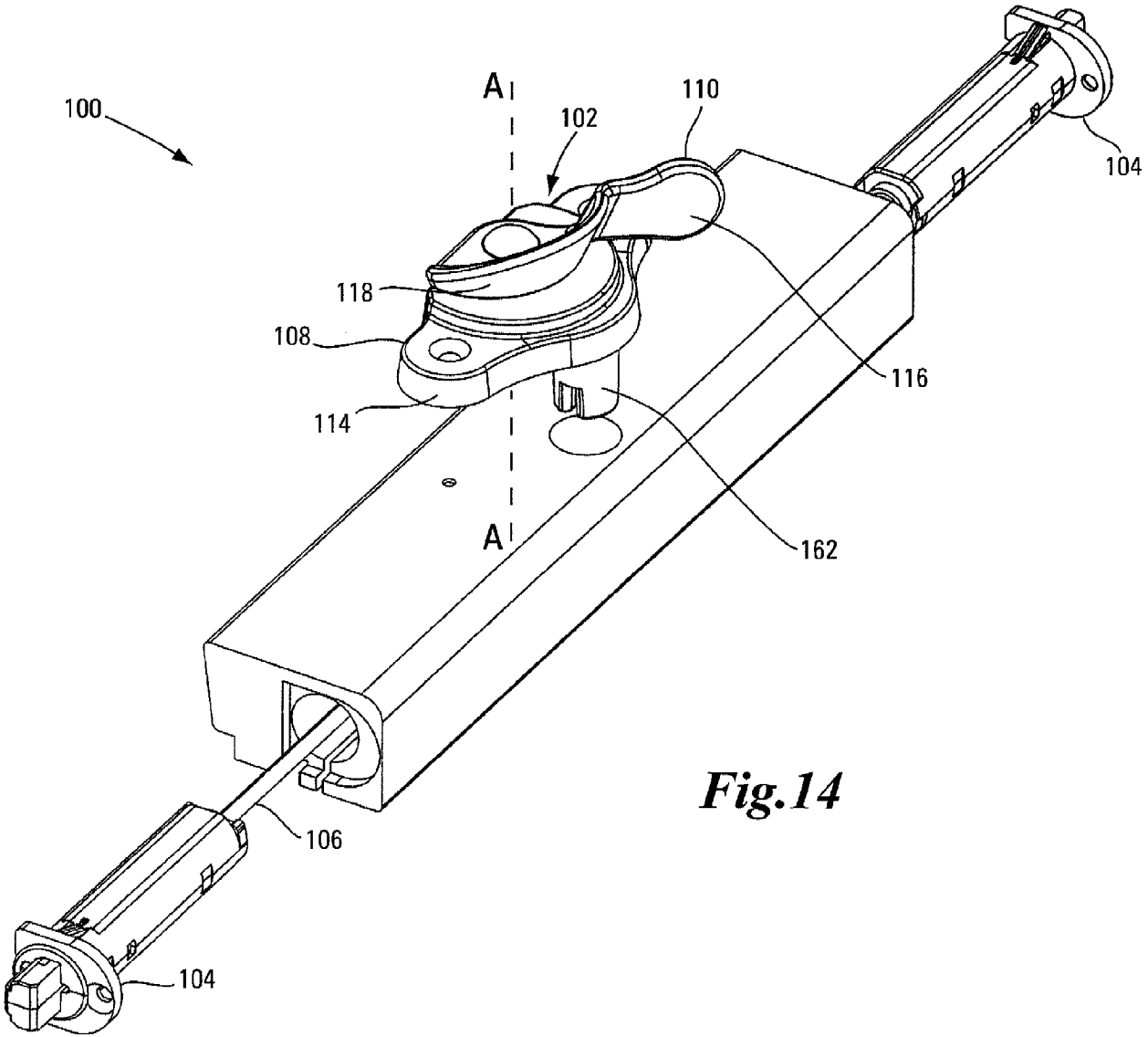
FIG. 14 is a perspective view of a window sash with an integrated lock and tilt-latch assembly according to an embodiment of the present invention.
Figure 15:
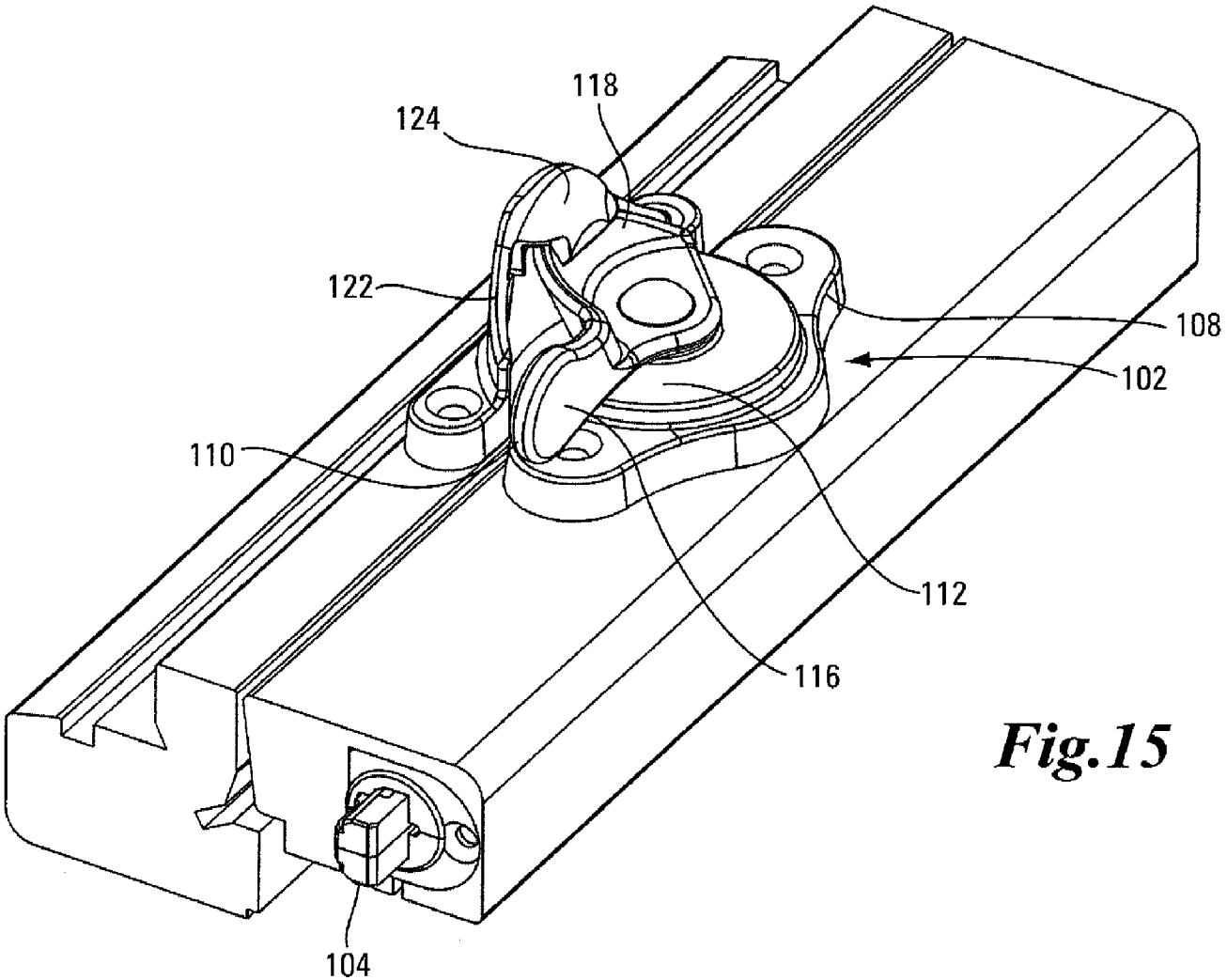
FIG. 15 is a perspective view of a window sash with an actuator assembly according to an embodiment of the present invention.

Locking tilt-latch assembly 100 is generally mounted onto double-hung window, as depicted in FIG. 13. As depicted in FIG. 14, locking tilt-latch assembly 100 generally includes actuator assembly 102, tilt-latch assemblies 104, and linking member 106. Actuator assembly 102 generally includes base assembly 108 and control lever 110. Base assembly 108 is defined by baseplate 112 and base housing 114. In an example embodiment, baseplate 112 and base housing 114 are assembled together such that baseplate 112 defines the top of base assembly 108, as depicted in FIG. 15. Control lever 110 has handle 116, sweep cam 118, and shank 120. Sweep cam 118 is generally tapered away from handle 116. As control lever 110 rotates, sweep cam 118 engages or disengages keeper 122. When control lever 110 is in a locked position, as depicted in FIG. 15, sweep cam 118 is positioned under and within locking tab 124 of keeper 122. Inside sash 310 of double-hung sash window 312 is thereby substantially prevented from being raised relative to frame 334.

Figure 19:
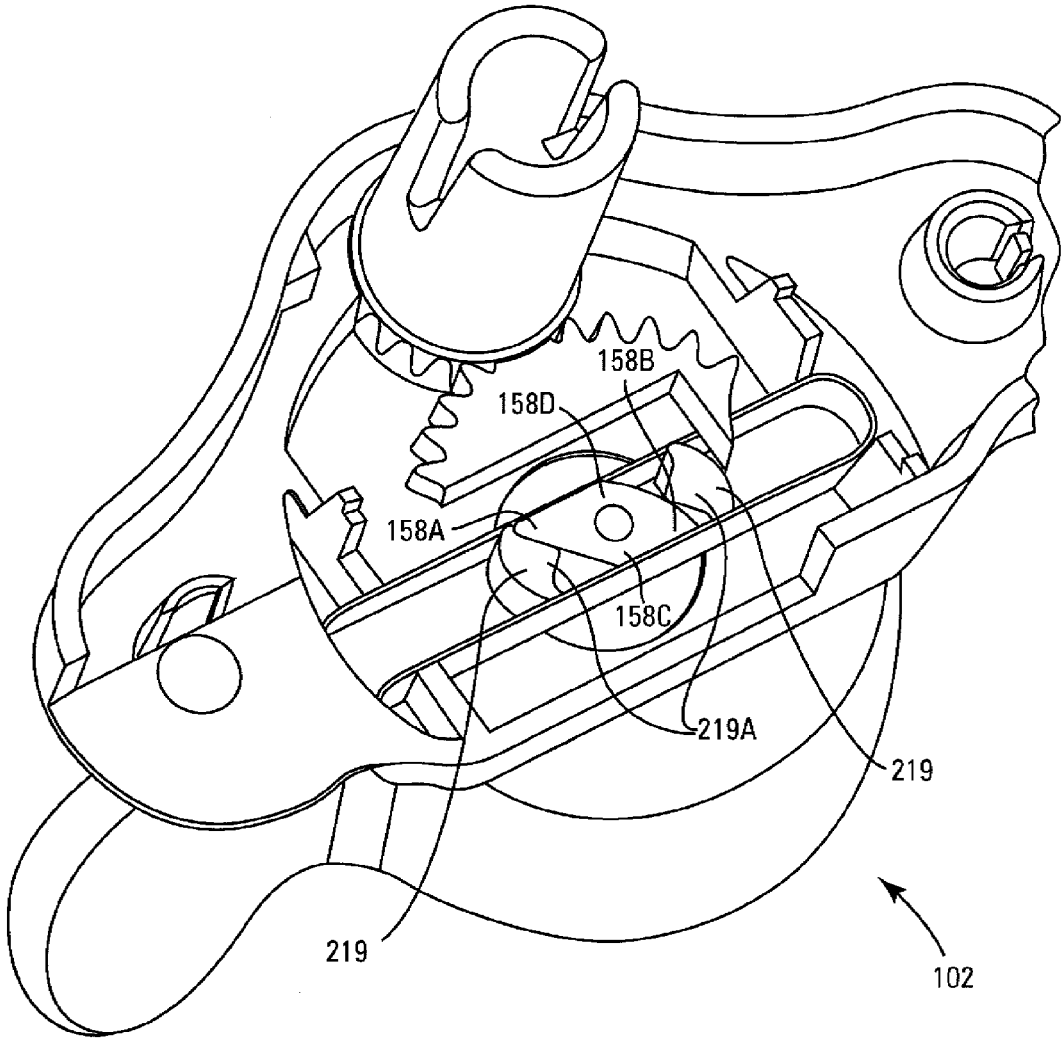
FIG. 19 is a sectional perspective view of an actuator assembly in a locked position according to an embodiment of the present invention.
Figure 20:
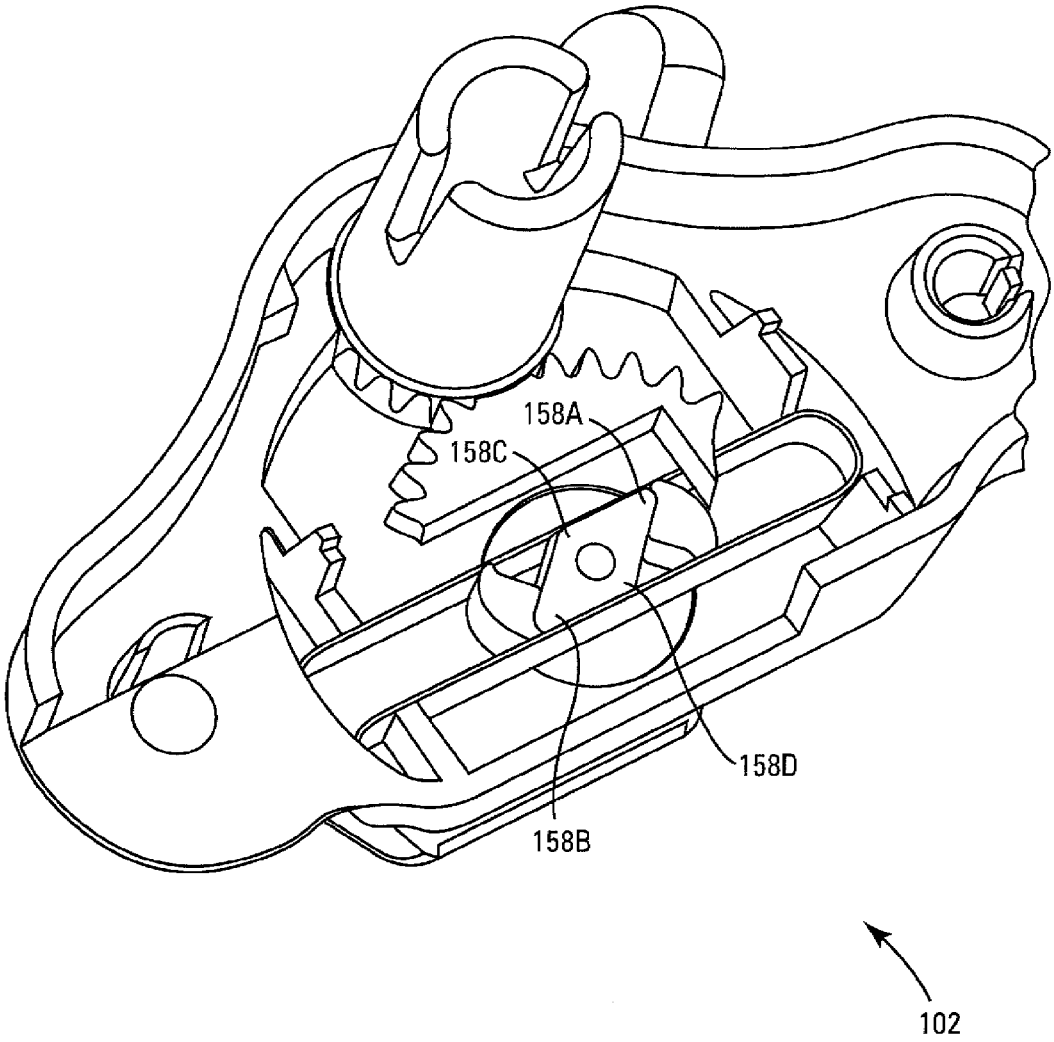
FIG. 20 is sectional perspective view of an actuator assembly in an unlocked position according to an embodiment of the present invention.
Figure 21:
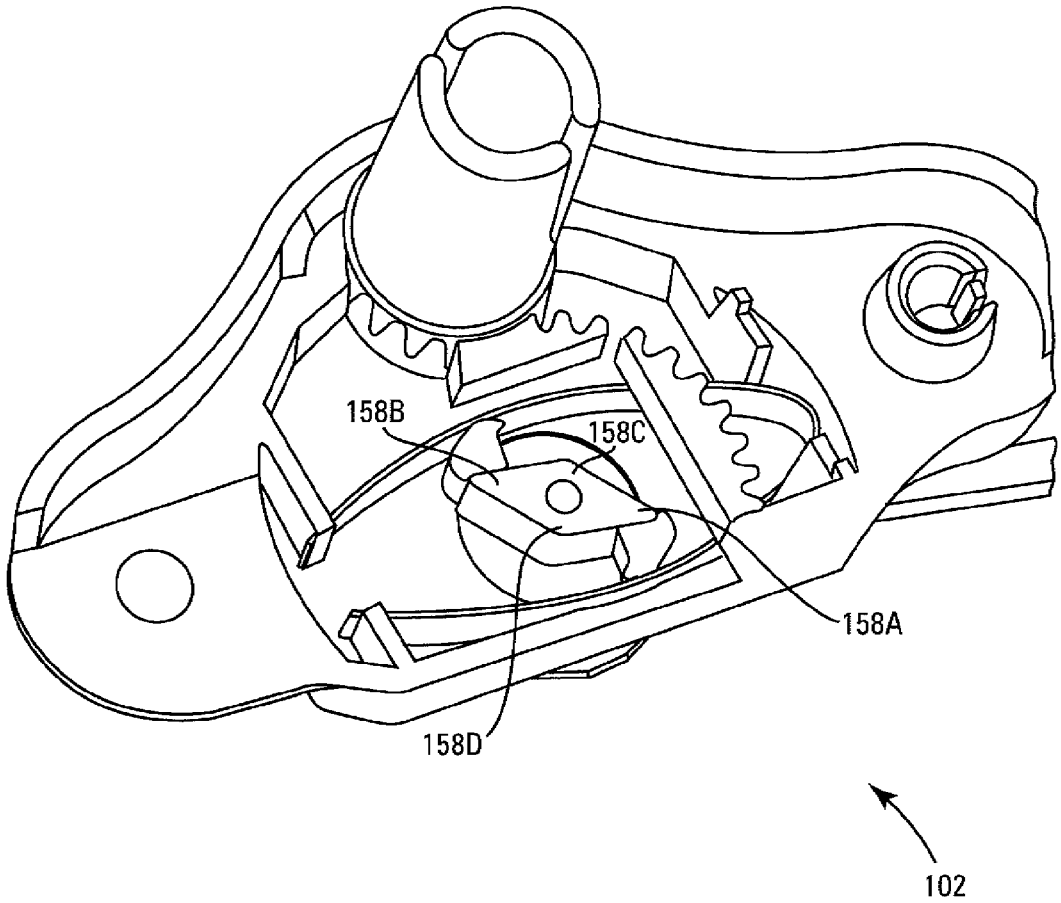
FIG. 21 is a sectional perspective view of an actuator assembly in a tilt position according to an embodiment of the present invention.
Figure 22:
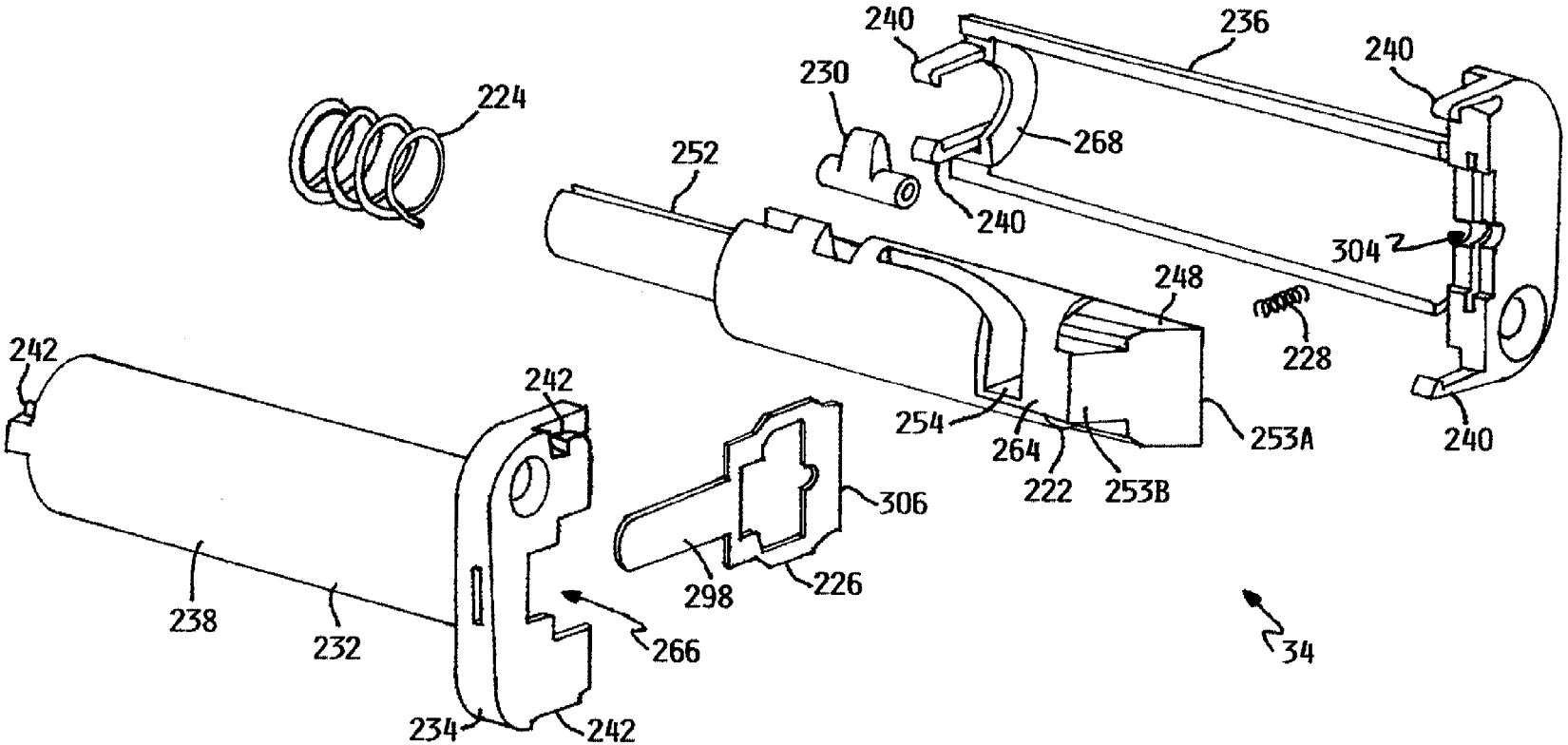
FIG. 22 is an exploded view of a tilt-latch assembly according to an embodiment of the invention.
Figure 23:
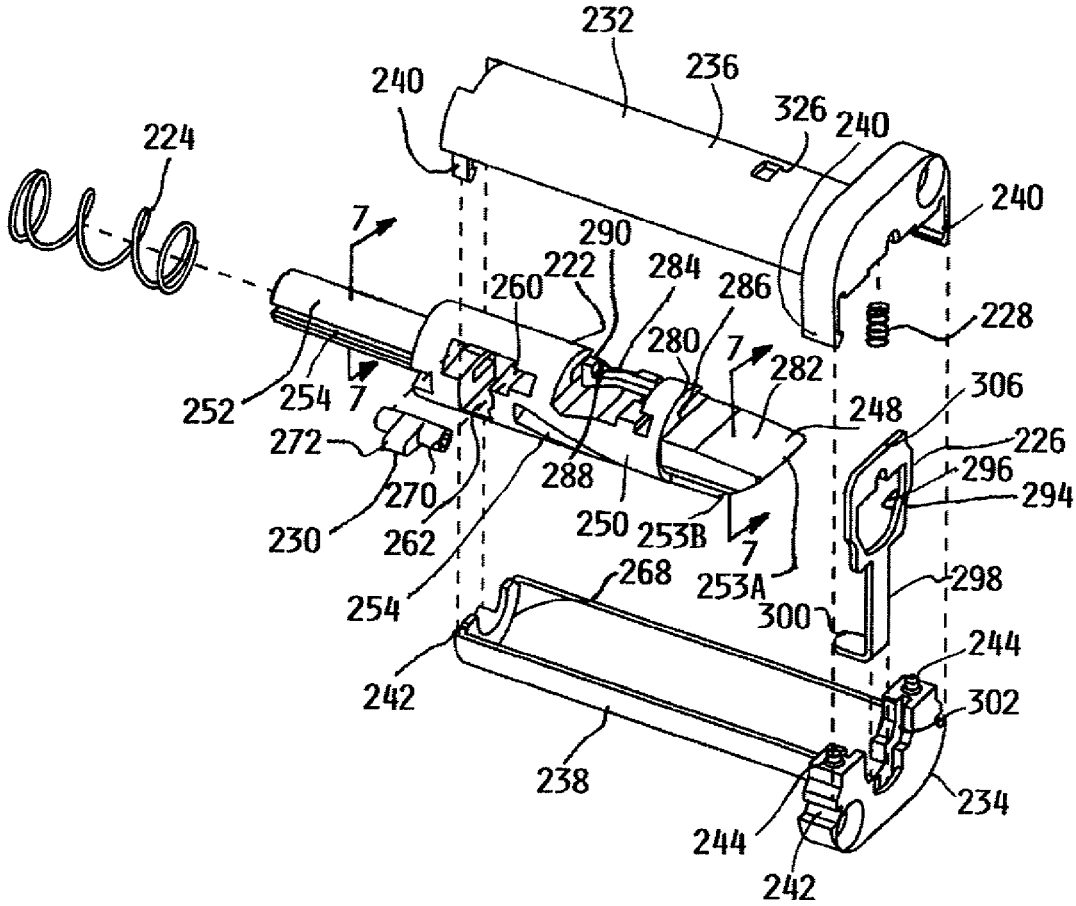
FIG. 23 is an exploded view of a tilt-latch assembly according to another embodiment of the invention.
Figure 24:
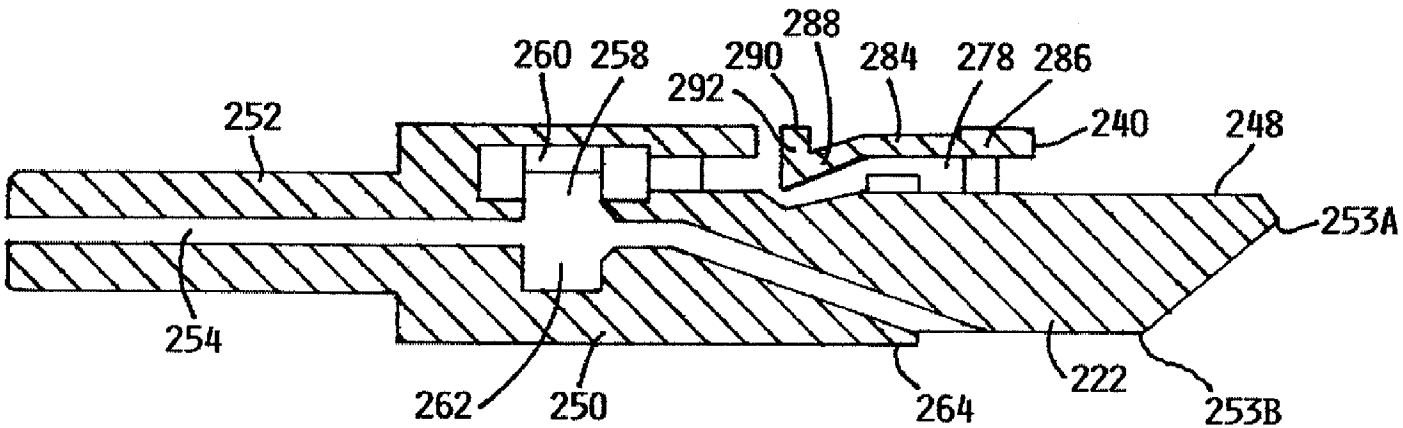
FIG. 24 is a cross-sectional view of the plunger portion of a tilt-latch assembly taken at Section 7-7 of FIG. 23.
Figure 25:
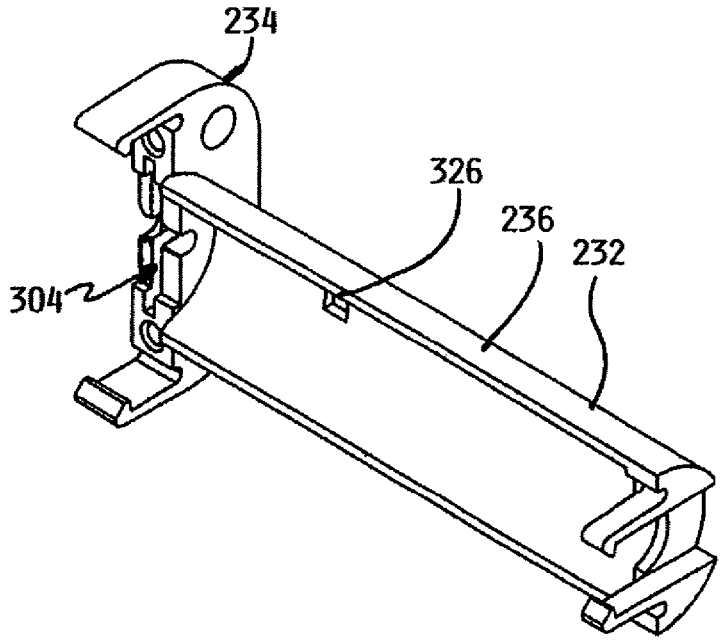
FIG. 25 is a perspective view of a first portion of the housing of the tilt-latch assembly of FIG. 23.
Figure 26:
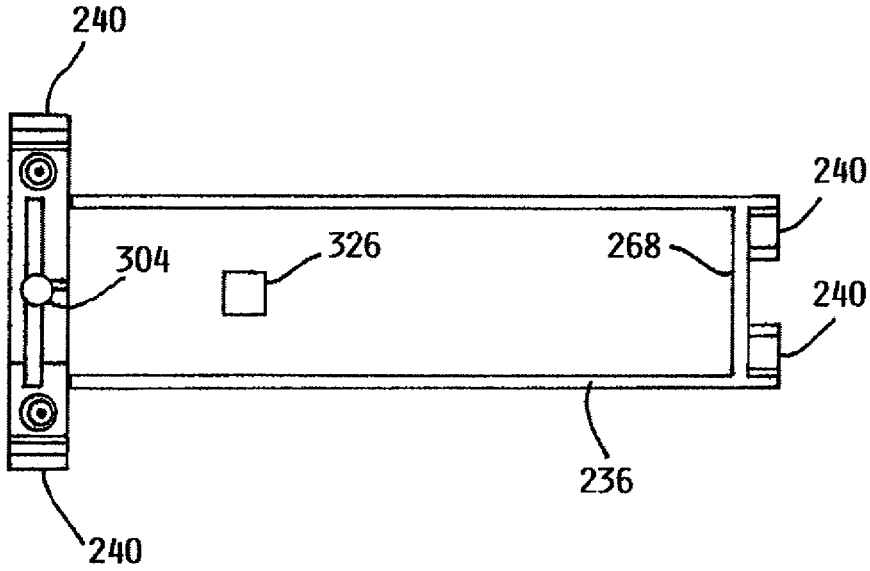
FIG. 26 is a side elevation view of the housing portion depicted in FIG. 25.
Figure 27:
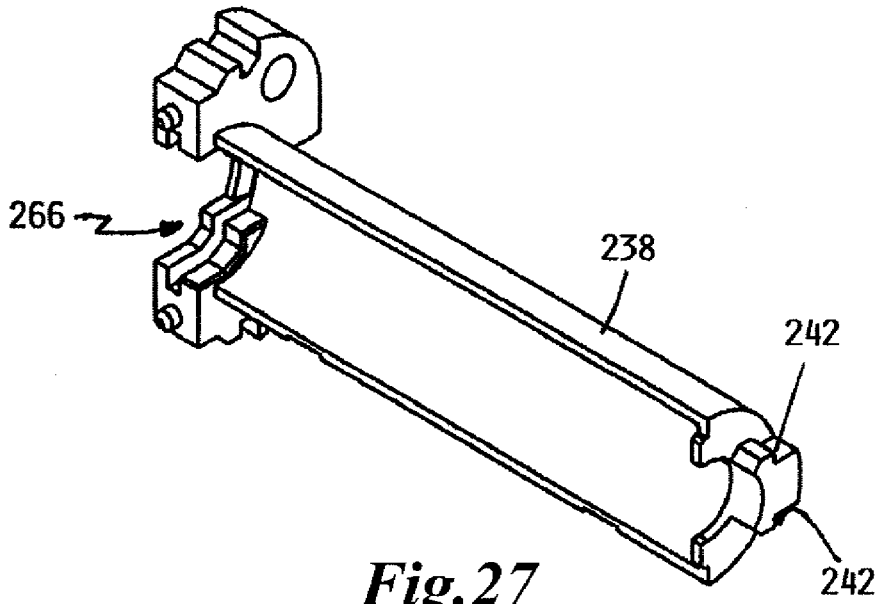
FIG. 27 is a perspective view of a second portion of the housing of the tilt-latch assembly of FIG. 23.
Figure 28:
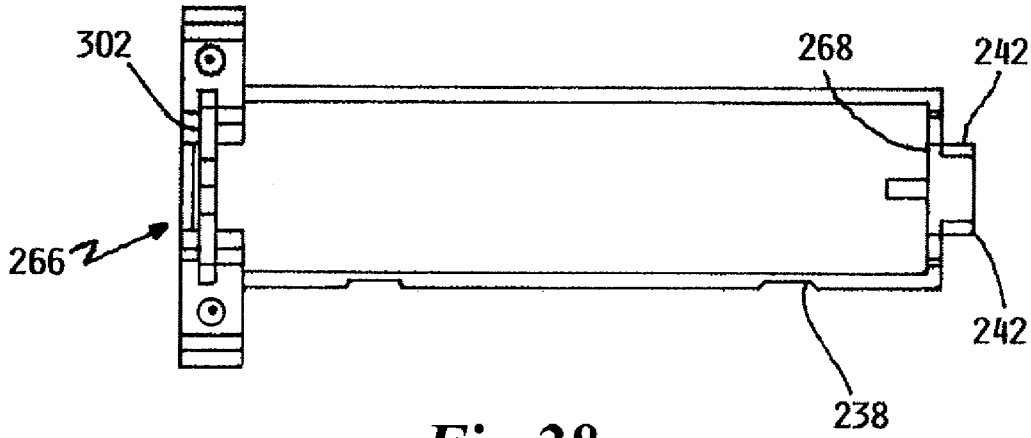
FIG. 28 is a side elevation view of the housing portion depicted in FIG. 27.
Figure 29:
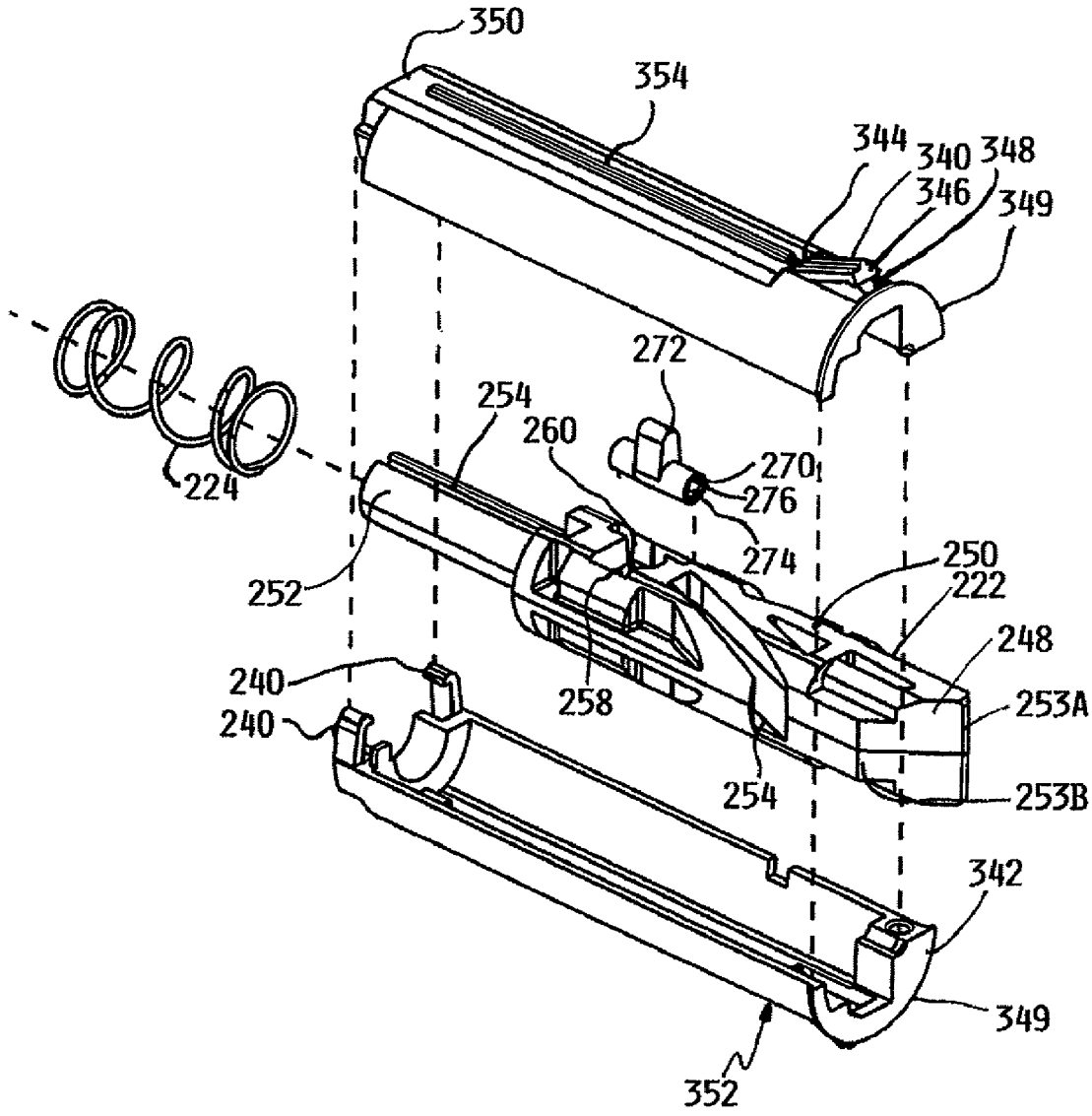
FIG. 29 is an exploded view of a tilt-latch assembly according to an embodiment of the invention.
Figure 30:
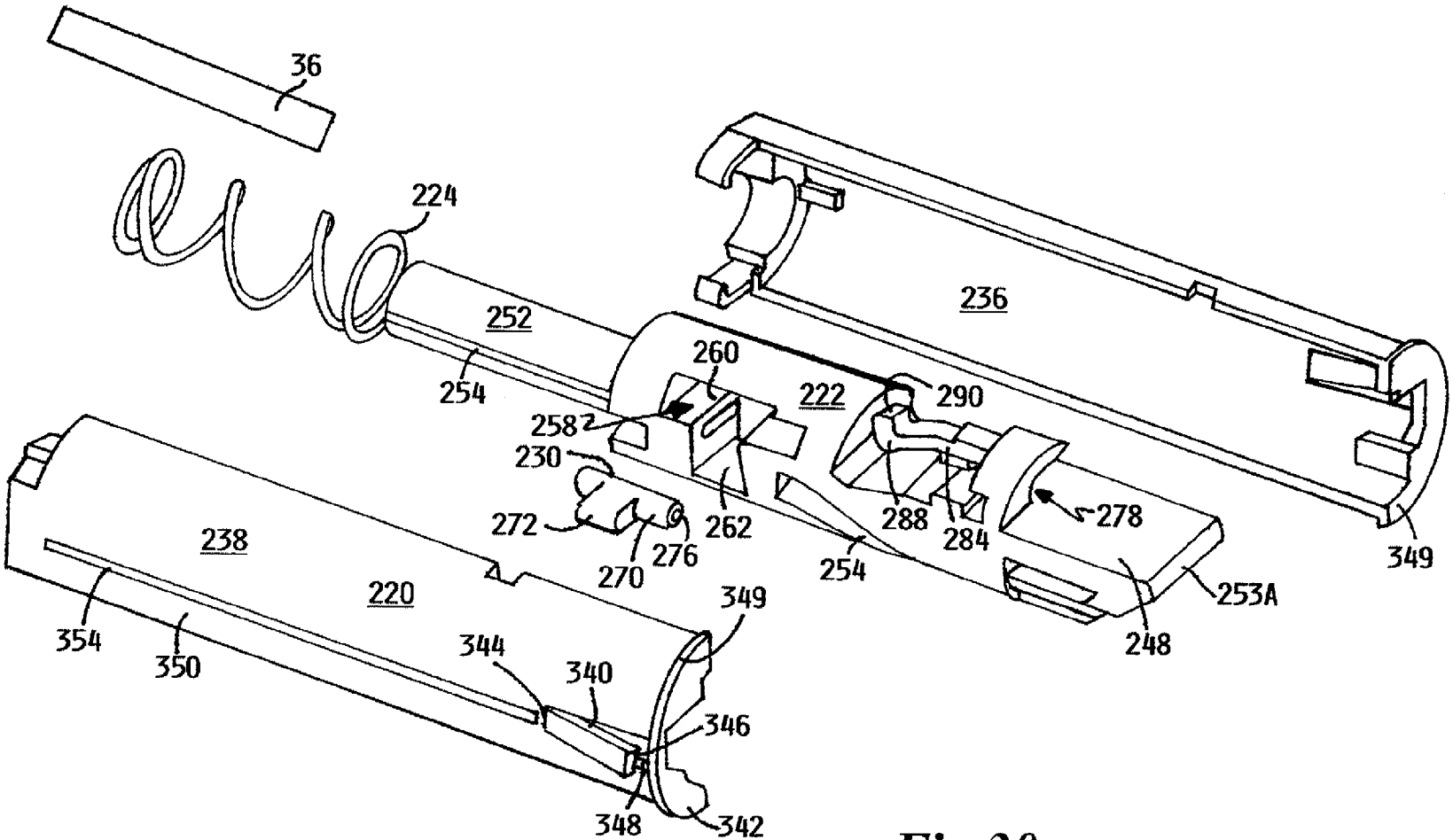
FIG. 30 is an exploded view of the tilt-latch portion of an integrated lock and tilt-latch assembly according to an embodiment of the present invention.
Figure 31:
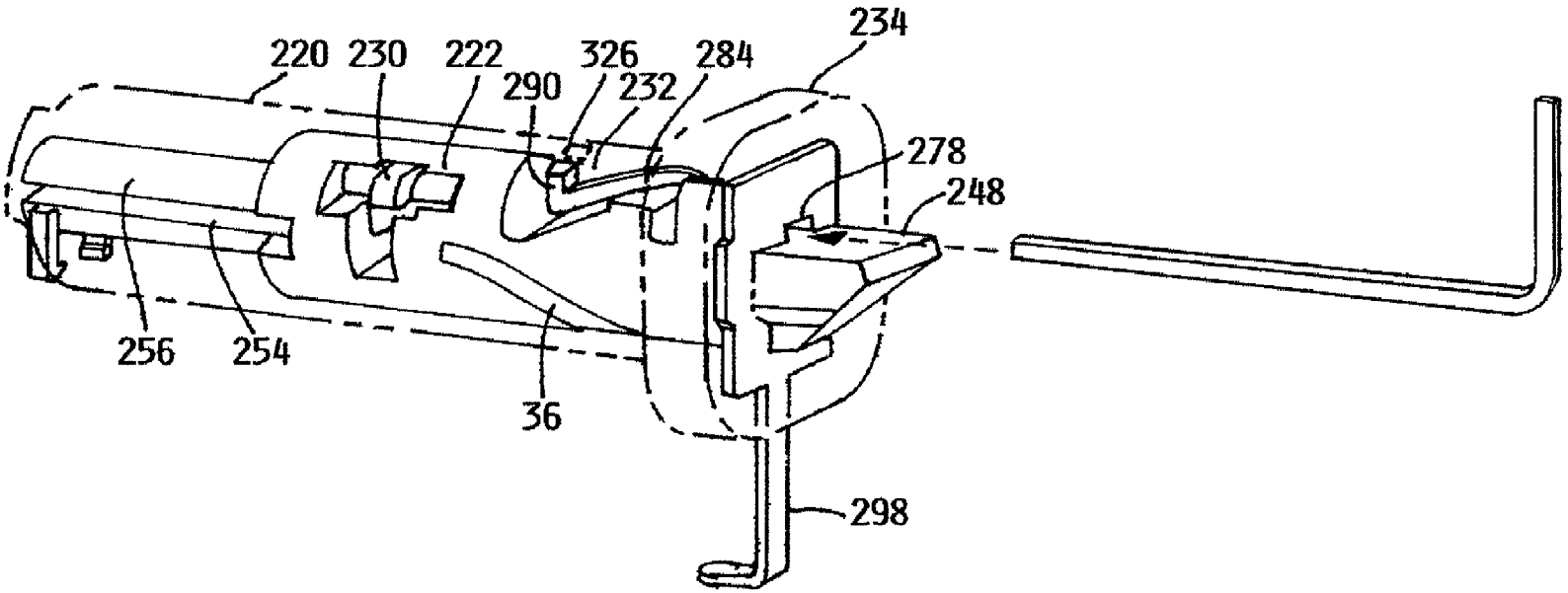
FIG. 31 is a perspective view of a tilt-latch assembly according to an embodiment of the invention with the housing depicted in phantom to reveal structures enabling locking of a linking member from outside the housing with a wrench.
Figure 32:
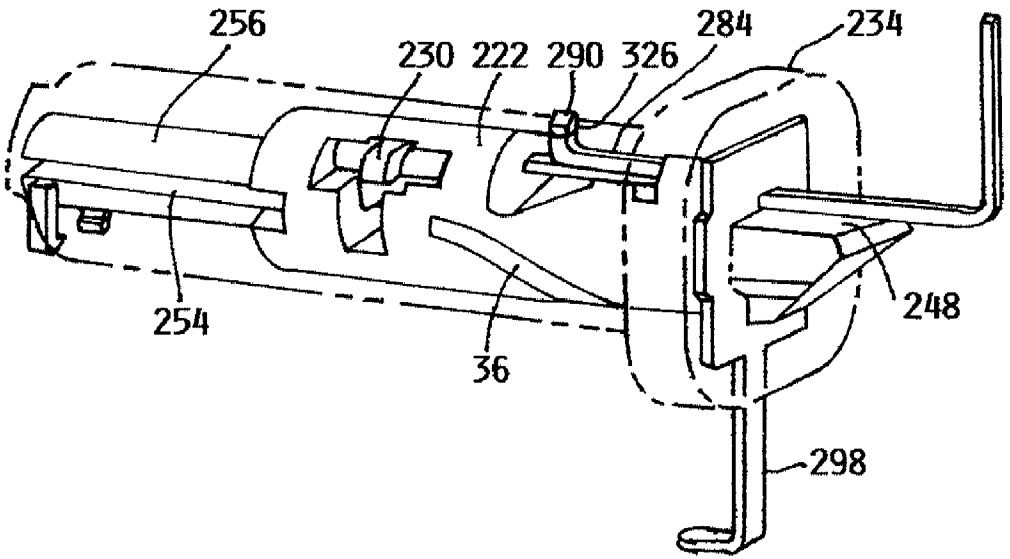
FIG. 32 depicts the tilt-latch assembly of FIG. 31 with the Allen wrench engaged with the locking cam member.
Figure 33:
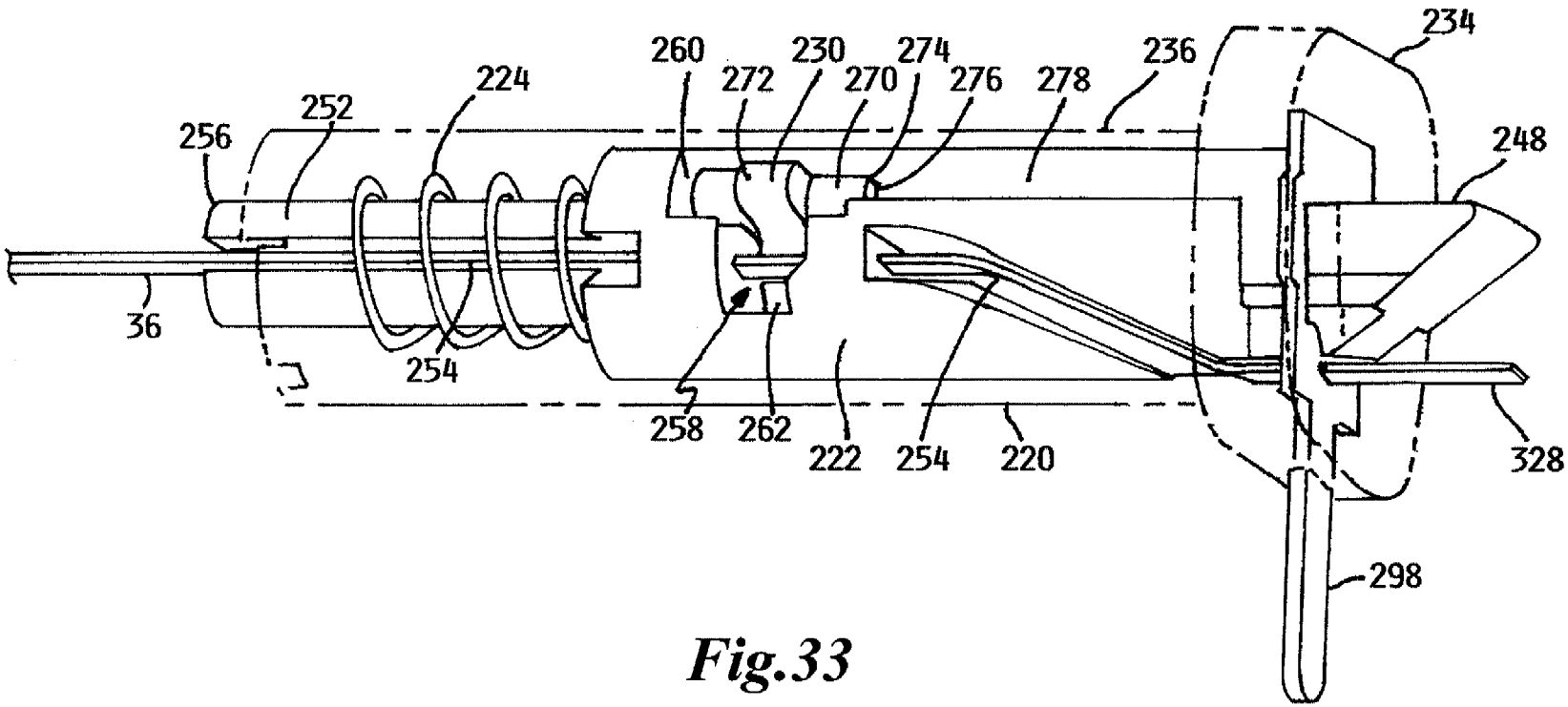
FIG. 33 is a perspective view of a tilt-latch assembly according to an embodiment of the invention with the housing depicted in phantom revealing the linking-member passage and locking member prior to locking of the linking member.

Control lever 110 is coupled to base housing 114 through shank-receiving aperture 126. Shank-receiving aperture 126 receives shank 120 of lever 110 therethrough. Shank 120 defines upper portion 128, lower portion 130, and middle portion 132. Upper portion 128 is generally cylindrical in shape. Upper portion 128 defines mating cylinder 134 with lateral surface 134A and outer edge 134B. Stop 136 is located on outer edge 138A of mating cylinder 134. Middle portion 132 is generally quadrangular in shape. Middle portion 132 forms cam 158 that may be trapezoidal in shape with acute corners 158A-B and obtuse corners 158C-D, as depicted in FIGS. 19-21. Lower portion 130 is generally cylindrical in shape. Lower portion 130 forms multi-level protrusions 138. Large-diameter protrusion 138A extends outwardly from cam 158, while small-diameter protrusion 138B extends outwardly from large-diameter protrusion 138A. Lip 139 is formed where large-diameter protrusion 138A and small-diameter protrusion 138B meet. Retainer 156 is received on small-diameter protrusion 138B of lower portion 130 of shank 120. Retainer 156 retains baseplate 112 and lever 110 on base housing 114 so that control lever 110 is rotatable about axis A-A relative to base housing 114, as annotated in FIG. 14.

As depicted in FIGS. 14-18, base assembly 108 generally includes baseplate 112, base housing 114, retainer 156, gear 160, spool 162, and biasing member 164. Underside 170 of base housing 114 defines recesses. The recesses include deep recess portion 173 and shallow recess portion 174. Underside 170 has upper ceiling 177A, lower ceiling 177B, and edge 181. The recesses receive middle portion 132 and lower portion 130 of shank 120, gear 160, a portion of spool 162, and biasing member 164. Upper ceiling 177A defines deep recess portion 173 and lower ceiling 177B defines shallow recess portion 174. Deep recess portion 173 has main recess portion 173A and side recess portions 173B-C. Edge 181, deep recess wall 183, and shallow recess wall 185 define the shape of deep recess portion 173 and shallow recess portion 74. Deep recess portion 173 is shaped conformingly to, and receives baseplate 112. The plane formed by edge 181 of base housing 114 defines the lower planar boundary of underside 170.

Extending downward from lower ceiling 177B are recess posts 140. Recess posts 140 generally are integral with upper ceiling 177A and lower ceiling 177B and do not extend beyond the plane formed by edge 181 of base housing 114. Recess posts 140 have main support sections 142 and support surfaces 143. Support surfaces 143 of recess posts 140 are substantially coplanar. Support posts 140A-B proximal to spool post 190 may have tip sections 144. When baseplate 112 is situated on recess posts 140 in deep recess portion 173, tip sections 144 resist lateral movement of baseplate 112. Lateral surface of tip sections 144 and edge 181 of base housing 114 are generally coplanar. Inner edges 146 of supports posts 140 and upper recess wall 183 are also generally coplanar. Inner edges 146 are substantially perpendicular to upper ceiling 177AA and lower ceiling 177B. Outer edges 148 of recess posts 140 are also substantially perpendicular to upper ceiling 177AA and lower ceiling 177B.

Also extending downward from lower ceiling 177B are mounting posts 186. Mounting posts define apertures 194 extending from underside 170 to top surface 178 of base housing 114. Apertures 194 receive fastening members which may be used to secure base assembly 108 to top surface 316 of double hung sash window 312.

Referring to FIGS. 17-21, biasing member 164 is secured in deep recess portion 173 between recess posts 140. Biasing member may be any number of flexible materials possessing shape memory characteristics, such as, for example, a spring in the geometry depicted in an example embodiment of the present invention or in a variety of other geometries that would impart biasing upon cam followers 219 or gear 160 and cam 158. Cam 158 and cam followers 219 are situated between flex regions 150, 152 of biasing member 164. Flex regions 150, 152 extend through main recess portion 173A and into side recess portions 173B,C. Generally, the distance between flex regions 150, 152 is approximately the distance between obtuse corners 158A,B of cam 158. In the embodiment depicted in FIG. 16, biasing member 164 also has curved joining region 154. Although only one biasing member 164 is depicted in FIGS. 16-21, alternative embodiments may include a pair of separate biasing members 164 — each biasing member 164 providing a separate flex region 150 or 152 — secured in deep recess portion 173 between recess posts 140.

Shank-receiving aperture 126 extends from deep recess portion 173 to top surface 178 of base housing 114. A boss (not shown) surrounds shank-receiving aperture 176 on top surface 178 of base housing 114. The boss defines a semi-circular inner recess (not shown) around shank-receiving aperture 176. The semi-circular inner recess (not shown) intersects an inner edge (not shown) of shank-receiving aperture 176. Stop 136 outer edge 134B of mating cylinder 134 of shank 120 is received in semi-circular inner recess 182. Stop 136 is situated substantially within the semi-circular inner recess. When upper portion 128 is positioned within shank-receiving aperture 176, the semi-circular inner recess forms a channel defined by outer edge 134B of mating cylinder 134 of shank 120 and the inner edge of the boss. The length of the semi-circular inner recess thereby limits the rotation of control lever 110 about axis A-A relative to base housing 114.

Spool post 190 projects downwardly from underside 170 of base housing 114. Spool post 190 generally is formed from wall 191 defining aperture 192. Aperture 192 is aligned in the longitudinal direction of base housing 114. Aperture 192 extends outwardly from underside 170 of base housing 114. Spool post 190 may also be a solid post such that spool post 190 does not have an aperture.

Figure 16:
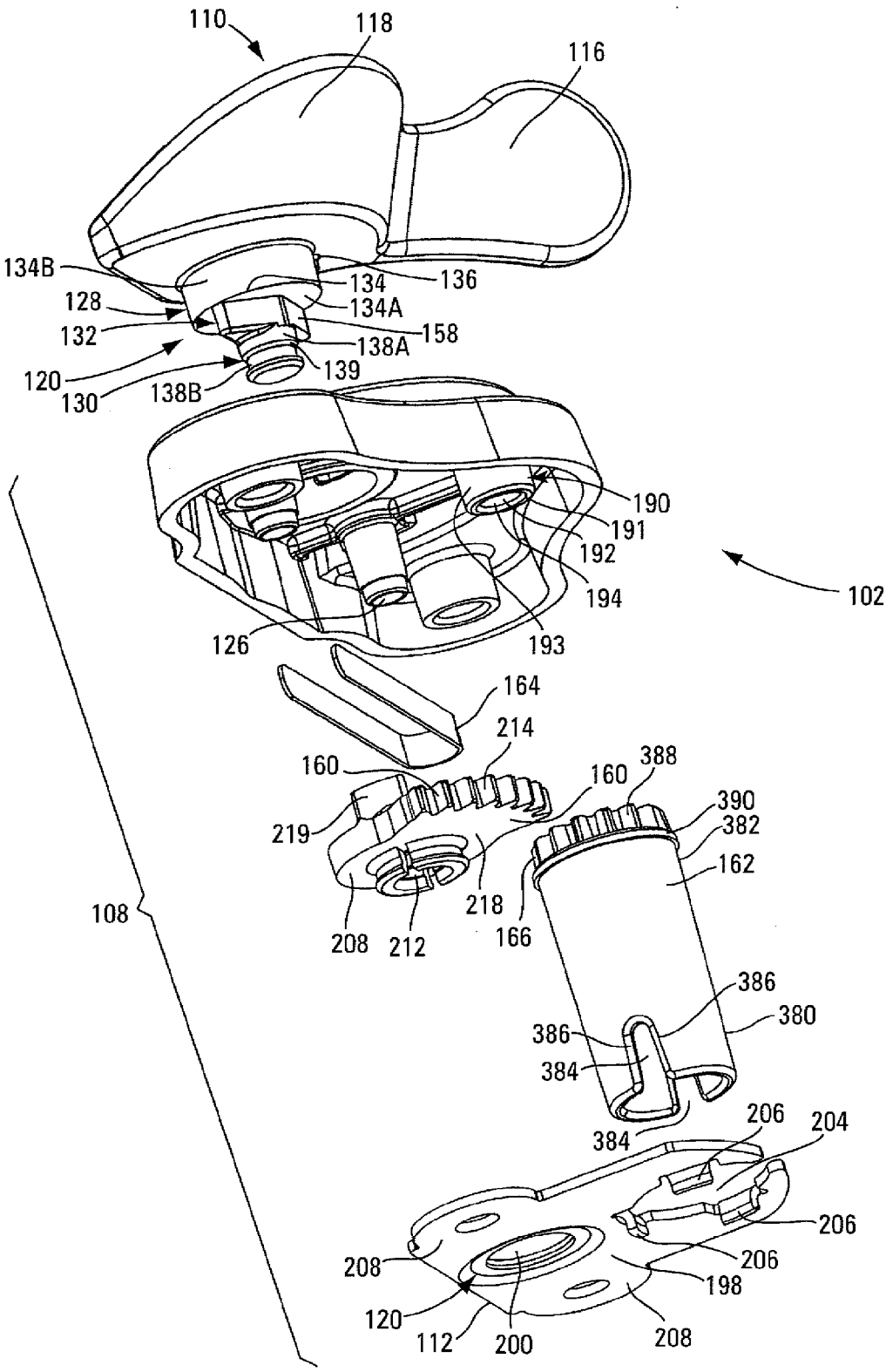
FIG. 16 is an exploded perspective view of an actuator assembly according to an embodiment of the present invention.

As depicted in FIG. 16, baseplate 112 generally has main portion 198 defining aperture 200, recessed retainer-holding area 202, semi-circular receiving opening 204, and alignment lugs 206. Baseplate 112 also has ears 208. Aperture 200 receives lower portion 130 of shank 120. Retainer 156 can be situated in recessed retainer-holding area 202. When retainer 156 is situated in recessed retainer-holding area 202, bottom surface 199 of main portion 198 and bottom surface 156A of retainer 156 are substantially coplanar. Semi-circular receiving opening 204 receives spool 162. Alignment lugs 206 extending downward at or near the perimeter of semi-circular receiving opening 204 to substantially retain spool 162 in the longitudinal direction of base housing 114.

Gear 160 has non-gear segment 210, gear hole 212, and gear segment 214 extending radially from gear hole 212, as depicted in FIG. 16. Gear segment 214 is formed in outer wall 221 of gear 160. Gear 160 has a top surface (not shown) opposite bottom surface 218. The top surface and bottom surface 218 are substantially parallel with upper ceiling 177AA and lower ceiling 177B. The top surface generally has recessed region (not shown). Extending upward from the top surface and the recessed region are cam followers 219. Circumference of recessed region 120 is substantially circular. The diameter of the recessed region is substantially the same as the linear distance between acute corners 158A-B of cam 158 such that cam 158 fits within the recessed region. The linear distance between tips 219A of cam followers 219 is greater than the linear distance between obtuse corners 158C-D of cam 158.

Gear 160 is rotatably received in deep recess portion 173 of underside 170 of base housing 114. Bottom surface 218 faces downward and the top surface faces upward. Gear segment 214 faces toward spool post 190 and non-gear segment 210 faces away from spool post 190. Shank 120 of control lever 110 extends through gear hole 212 of gear 160. Lower portion 130 extends through gear hole 212 such that both large-diameter protrusion 138A and small-diameter protrusion 138B extend downward through gear hole 212 past bottom surface 218. Generally, shank 120 of control lever 110 is inserted through aperture 126 of base housing 114 and lower portion 130 of shank 120 is inserted through gear hole 212 of gear 160. Cam followers 219 occupy the space between acute corners 158A,B of cam and opposite biasing members 164, as depicted in FIG. 17-21. Lateral surfaces (not shown) of cam followers 219 coextensively interact with upper ceiling 177A and lateral surface 134A of mating cylinder 134.

Spool 162 generally includes lower portion 380 and upper portion 382, as depicted in FIG. 16. Lower portion 380 defines slots 384 extending upwardly from bottom edge 385. Slots 384 may have chamfered edges 386. Lower portion 380 may be tapered such that the circumference of lower portion 380 decreases toward lower portion 380. Upper portion 382 defines gear sector 388. Gear sector 388 is formed in a portion of top edge 166 of upper portion 382 and matingly engages gear segment 214 of gear 160. Between lower portion 380 and upper portion 382 is spool lip 390. Spool lip 390 presents a raised edge that circumferentially extends beyond lower portion 380 and upper portion 382.

Spool 162 is rotatably received by semi-circular receiving opening 204 of baseplate 112 and rotatably positioned over spool post 190. Lower portion 380 of spool 162 extends below baseplate 112 and upper portion 382 of spool 162 extends above baseplate 112 proximate the lower surface of spool lip 390. Alignment lugs 206 stabilize spool 162 on spool post 190. Alignment lugs 206 also present a barrier that prevents spool lip 390 from passing through semi-circular receiving opening 204. With baseplate 112 secured in place by retainer 156, spool 162 is secured in place from above by lower ceiling 177B and from below by semi-circular receiving opening 204. Movement of spool 162 is thereby substantially limited to rotational movement around spool post 190.

Gear 160 and spool 162 are desirably made from easily moldable, durable polymer material such as acetal or nylon. Control lever 110 and base housing 114 are preferably cast from suitable metallic material such as zinc alloy. Baseplate 112 and biasing member 164 are preferably die cut or stamped from metallic sheet material. Any of the above components, however, may be made from any other suitable material such as polymer or metal. In the depicted embodiments, actuator assembly 102 is easily assembled by mating control lever 110 and base housing 114. Biasing member 164 may then be placed in deep recess portion 173 between side recess portions 173 B,C about obtuse corners 158 C,D of cam 158. With control lever 110 positioned in an unlocked position, lower portion 130 of shank 120 may receive gear 160 such that gear segment 214 faces spool post 190 and cam followers 219 are situated between biasing members 164. Upper portion 382 of spool 162 is positioned about spool post 190 so that gear sector 388 of spool 162 matingly engages gear segment 214 of gear 160 and slots 384 are aligned parallel to flexible linking member 106. Baseplate 112 is positioned such that semi-circular recess 182 receives spool 162, spool 162 enters baseplate 112 from the top surface (not shown) and exits bottom surface 199 of baseplate 112. Aperture 200 of baseplate 112 receives lower portion 130 of shank 120. Ears 208 of baseplate 112 rest between recess posts 140 on support surfaces 144 of recess posts 140. Retainer 156 is assembled to small-diameter protrusion 138B within recessed retainer-holding area 202 and mechanically secured with a fastening member, such as, for example, a stake or spinning apparatus in example embodiments. Retainer 156 is pushed or pressed about small-diameter protrusion 138B with locking tab features so as to be secured within recessed retainer-holding area 202.

Referring to FIG. 17-21, underside 170 of actuator assembly 102 is shown with control lever 110 in locked (FIGS. 17-19), unlocked (FIG. 20), and tilt (FIG. 21) positions. Although the following description of how actuator assembly 102 functions is made in relation to the orientation of actuator assembly 102 depicted in the figures, it should be understood that directional descriptions would be reversed when actuator assembly 102 is installed and underside 170 is facing downward. For example, clockwise rotation of spool 162 in relation to the orientation of actuator assembly 102 depicted in FIGS. 17-21 corresponds to counter-clockwise rotation of control lever 110 in actuator assembly 102 installed on top surface 316 of double hung sash window 312.

Figure 17:
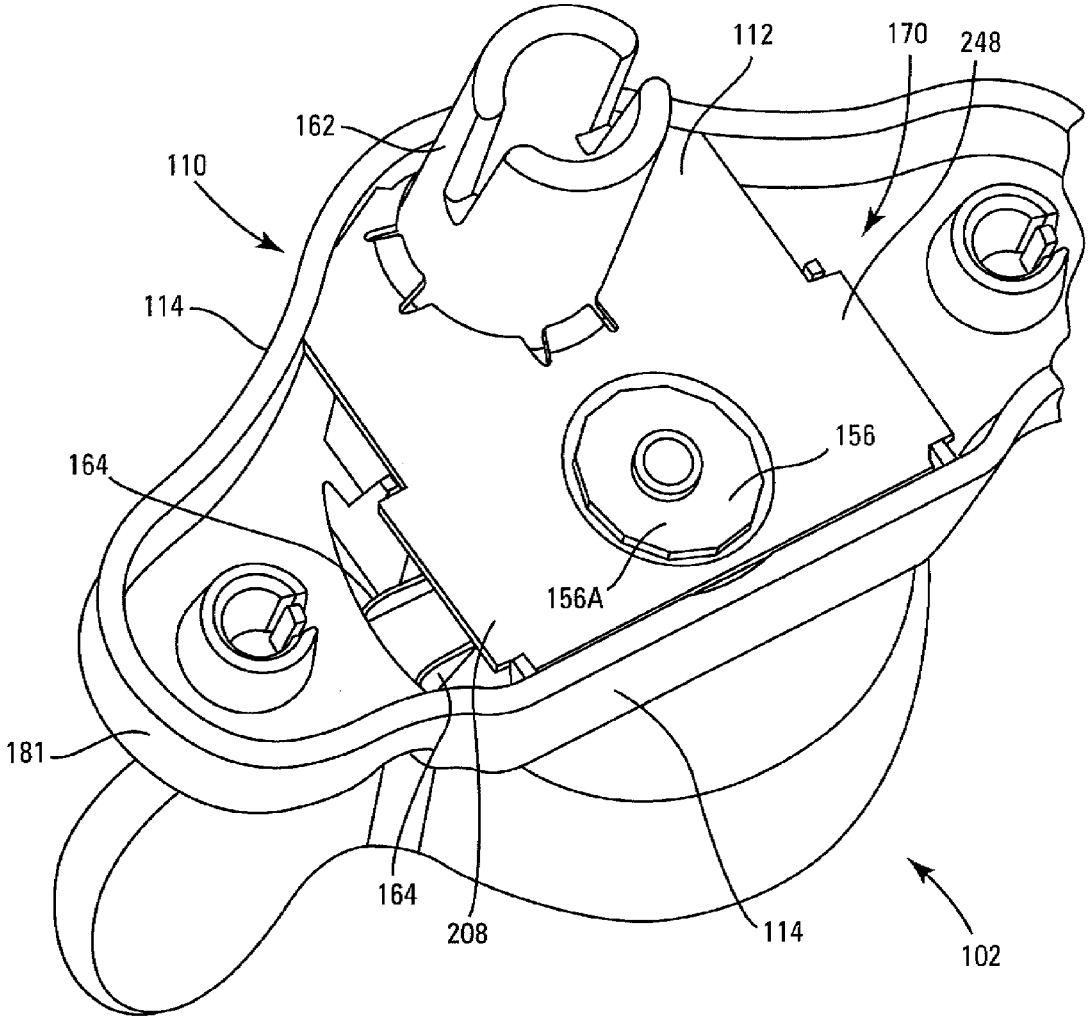
FIG. 17 is a sectional perspective view of an actuator assembly in a locked position according to an embodiment of the present invention.
Figure 18:
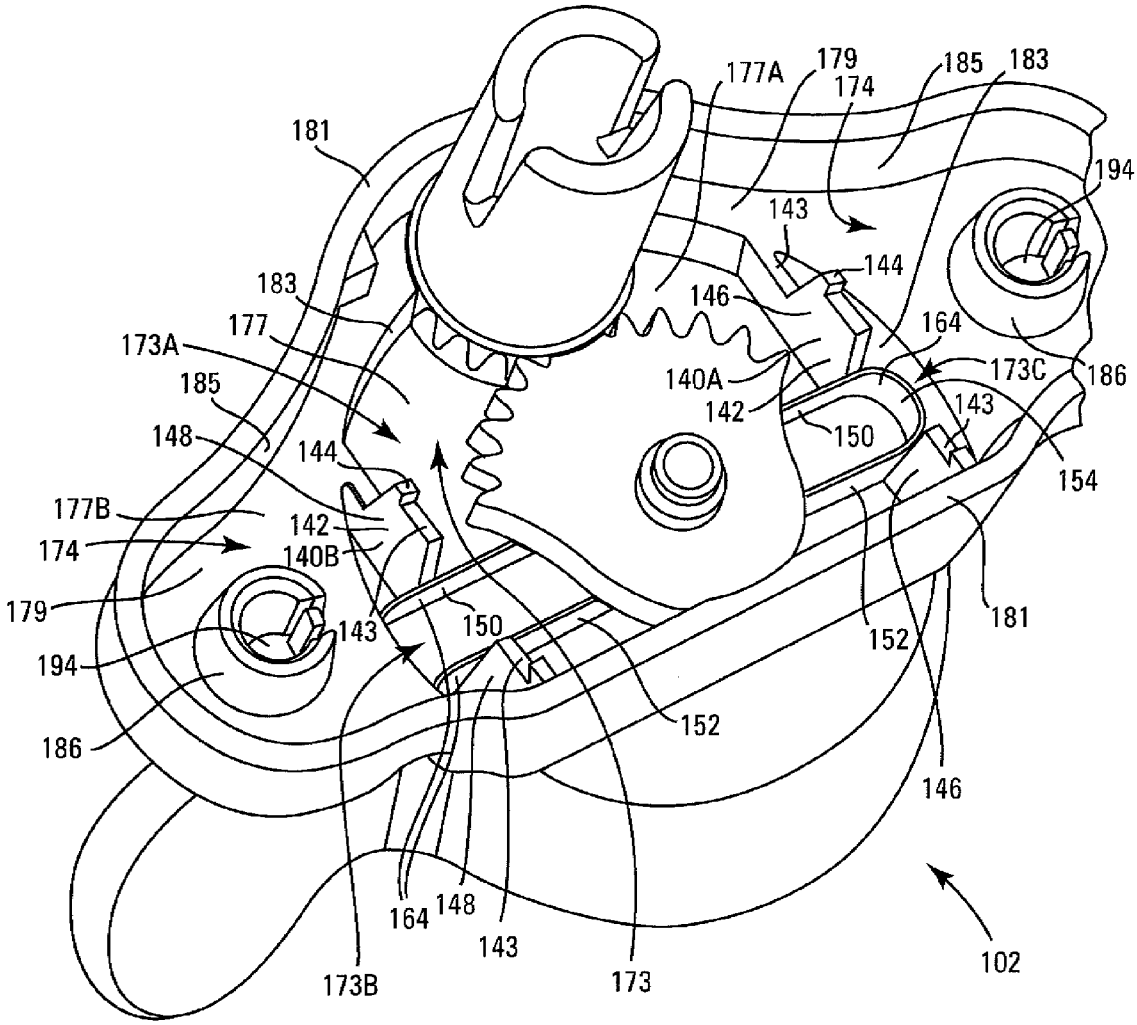
FIG. 18 is a sectional perspective view of an actuator assembly in a locked position according to an embodiment of the present invention.

Referring to FIGS. 17-19, control lever 110 is in a locked position. In the locked position, handle 116 is approximately in an nine-o'clock position and acute corners 158A, B of cam 158 are approximately in a ten-o'clock-to-four-o'clock position. The position of control lever 110 depicted in FIGS. 17-19 is in the same locked position occupied by control lever 110 depicted in FIG. 15, which illustrates an installed tilt lock latch assembly 100. The resiliency of biasing member 164 substantially maintains cam 158 in place so that control lever 110 remains in the locked position.

To disengage sweep cam 118 from keeper 122, control lever 110 is rotated in a clockwise direction to an unlocked position, as depicted in FIG. 20. In the unlocked position, control lever 110 is approximately in a two-o'clock position and acute corners 158A, B of cam 158 are approximately in a two-o'clock-to-eight-o'clock position. By rotating control lever 110 in a clockwise direction, cam 158 is able to rotate between cam followers 219 without rotationally engaging gear 160. Since gear 160 remains rotationally stationary as control lever 110 is rotated from the locked position to the unlocked position, spool 162 is not rotationally actuated.

Referring to FIGS. 17-19, control lever 110 is shown in the locked position with sweep cam 118 positioned so as to engage keeper 122. Cam 158 is positioned between flex regions 150, 152 of biasing member 164. In other embodiments, cam 158 is positioned between two substantially parallel biasing members 164. When control lever 110 is in the locked position, biasing member 164 restrains cam 158 rotationally and is neutrally biased, exerting no biasing force on cam 158, as depicted in FIGS. 17-19. Thus, biasing member 164 provides a favored position for control lever 110 in the locked position.

If cam 158 is rotated clockwise as depicted in FIGS. 17-19 (from a normal, or overhead, view as depicted in FIG. 15, the direction would be reversed), however, biasing member 164 will be biased in deformation and will exert a steadily increasing biasing force in an opposite, or a counter-clockwise, direction. This counter-clockwise biasing force serves as a "soft" rotational stop for cam 158 in the clockwise rotational direction from the locked position. Cam 158 is substantially prevented from counter-clockwise rotation from locked position by stop 136, which impedes counter-clockwise rotation from the locked position upon reaching the end of semi-circular recess 182 of base housing 114.

If control lever 110 is rotated further in the clockwise direction, cam 158 can be positioned so that the biasing force exerted by biasing member 164 is directed through the center of cam 158. In this intermediate position, which can include a range of rotational travel, biasing member 164 exerts little or no rotational biasing force on cam 158. Rather, biasing member 164 restrains cam 158 between the locked and unlocked positions. In the intermediate position, sweep cam 118 may partially engage keeper 122. The range in which cam 158 is restrained in the intermediate position is substantially determined by the biasing force of biasing member 164 and the shape of cam 158. The corners 158A-D of cam 158 can be rounded to eliminate or minimize the movement-deadening effect on cam 158 of the intermediate position. In an example embodiment, corners 158A-D of cam 158 are sounded so as to have substantially similar radii of curvature.

As control lever 110 is further rotated in the clockwise direction past the intermediate position, biasing member 164 exerts a biasing force, now urging cam 158 in the clockwise direction. The rotational biasing force exerted by biasing member 164 steadily decreases as biasing member 164 returns to form. Once cam 158 reaches the unlocked position as shown in FIG. 20, biasing member 158 again reaches a neutral position and exerts no rotational biasing force in either direction. Thus, biasing member 164 has another favored position in the unlocked position. As before, if cam 158 is rotated further clockwise from this neutral position, biasing member 164 is loaded in deformation and exerts a steadily increasing rotational biasing force urging cam 158 and cam followers 21 counter-clockwise with a higher force than previously experienced due to the increased deformation caused by the addition of cam followers 219. Therefore, when control lever 110 is further rotated in the clockwise direction to a tilt position, as depicted in FIG. 21, and then released the biasing force of biasing member 164 on cam 158 and cam follower 219 returns control lever 110 and cam 158 to the unlocked position.

To tilt inside sash 310 of double-hung sash window 312, control lever 110 is rotated in a clockwise direction to a tilt position, as depicted in FIG. 21. In the tilt position, handle 116 is approximately in a three-o'clock position and acute corners 158A,B of cam 158 are approximately in a four-o'clock-to-ten-o'clock position. By continuing to rotate control lever 110 in a clockwise direction, the rotation of cam 158 causes acute corners 158A,B to rotate cam followers 219 of gear 160 in a clockwise direction. As gear 160 rotates, gear segment 214 rotationally engages gear sector 388 of spool 162. Since gear 160 rotates in a clockwise direction, spool 162 is caused to rotate in a counter-clockwise direction. As cam 158 rotates in a clockwise direction from the unlocked position to the tilt position, biasing member 164 exerts parallel forces on cam followers 219 that increasingly resist clockwise rotation of gear 160. As depicted in FIG. 21, the continued clockwise rotation of control lever 110 and cam 158 past the tilt position when control lever 110 is fully in the tilt position is impeded by stop 136, which impedes clockwise rotation from the tilt position upon reaching the end of semi-circular recess 182 of base housing 114. The position of stop 136 in relation to gear segment 214 also prevents the cam 158-cam followers 219 combination from reaching or passing the directional fulcrum created by the forces exerted by biasing member 164 on cam followers 219. Therefore, at any point between the unlocked position and the tilt position, control lever 110 will return to the unlocked position if an operator removes the rotational force from control lever 110.

As depicted in FIGS. 22-50, each tilt-latch assembly 104 generally includes housing 220, plunger 222, primary spring 224, plunger-latch 226, latch spring 228, and locking cam 230. Housing 220, generally includes barrel portion 232 and face plate 234. In embodiments of the invention as depicted, for example, in FIGS. 5, 6, 8-11, and 13, housing 220 may be formed in two sections 236, 238, which mate along the longitudinal axis of housing 220. In these embodiments first housing section 236 has projecting hooks 240, which engage shoulder structures 242 of second housing section 238 to secure the two sections 236, 238, together. Second housing section 238 may also have locating pins 244, which are received in recesses 246 to inhibit relative movement between the sections 236, 238.

Plunger 222 generally includes latch-bolt portion 248, central body portion 250, and tail portion 252. End 253 of latch-bolt portion 248 is tapered from leading edge 253A to shoulder 253B. Channel 254 extends axially from end 256 through tail portion 252. Central body portion 250 defines lock cavity 258 which includes a first portion 260 extending longitudinally within plunger 222, and a second portion 262 extending transversely to first portion 260. Channel 254 continues axially from tail portion 252 through second portion 262 of lock cavity 258, and emerges at outer surface 264 of central body portion 250 proximate shoulder 253B of latch-bolt portion 248.

Plunger 222 is received in barrel portion 232 of housing 220 with latch-bolt portion 248 extending through conformingly shaped aperture 266 defined by face plate 234. Primary spring 224 is received over tail portion 252 and bears against back wall 268 of housing 220 and central body portion 250 to bias plunger 222 toward face plate 234.

Locking cam 230 generally includes axle portion 270 and radial protrusion 272. End 274 of axle portion 270 has hex socket 276 adapted to receive an Allen wrench of standard dimension. Locking cam 230 is received in lock cavity 258 with axle portion 270 extending axially and rotatable within first portion 260 and radial protrusion 272 within second portion 262. Bore 278 is axially aligned with axle portion 270 and extends from first portion 260 of lock cavity 258 through to front end 280 of central body portion 250 proximate face 282 of latch-bolt portion 248. Adjustment latch arm 284 extends rearwardly from front wall 286 of central body portion 250, and includes angled portion 288 which intersects bore 278 and laterally projecting tab 290 at end 292.

Plunger-latch 226 has plate portion 294 defining aperture 296 which is conformingly shaped with the cross-section of latch-bolt portion 248. Trigger portion 298 extends from plate portion 294 and has bent end portion 300. Plate portion 294 is slidingly received in transverse slot 302 in face plate 234. Latch spring 228 is received in recess 304 and bears against edge 306 of plate portion 294 to bias plunger-latch 226 in the direction of trigger portion 298.

In embodiments of the invention housing 220 and plunger 222 of locking tilt-latch assembly 100 are made from low-cost, easily formable acetal polymer material. These components, however, may also be made from any material having sufficient strength and suitable durability characteristics. Primary spring 224, plunger-latch 226, latch spring 228, and locking cam 230 are desirably made from metallic material, but may also be made from any other suitable material. In the depicted embodiments, locking tilt-latch assembly 100 may be easily assembled by first assembling plunger-latch 226 and latch spring 228 with separate housing sections 236, 238, and locking cam 230 and primary spring 224 with plunger 222. Plunger 222 may then be placed in one of housing sections 236, 238, and the housing sections snapped together by mating projecting hooks 240 with shoulder structures 242 and locating pins 244 with recesses 246.

Referring to FIG. 13, locking tilt-latch assembly 100 is received in top rail 308 of inside sash 310 of a double-hung sash window 312. Top rail 308 generally has a cavity (not shown) defined in top surface 316 for receiving base assembly 108 with spool 162 disposed in lower cavity portion 318. A lateral bore (not shown) extends between the side faces (not shown) of top rail 308 and intersects the lower cavity portion.

Figure 34:
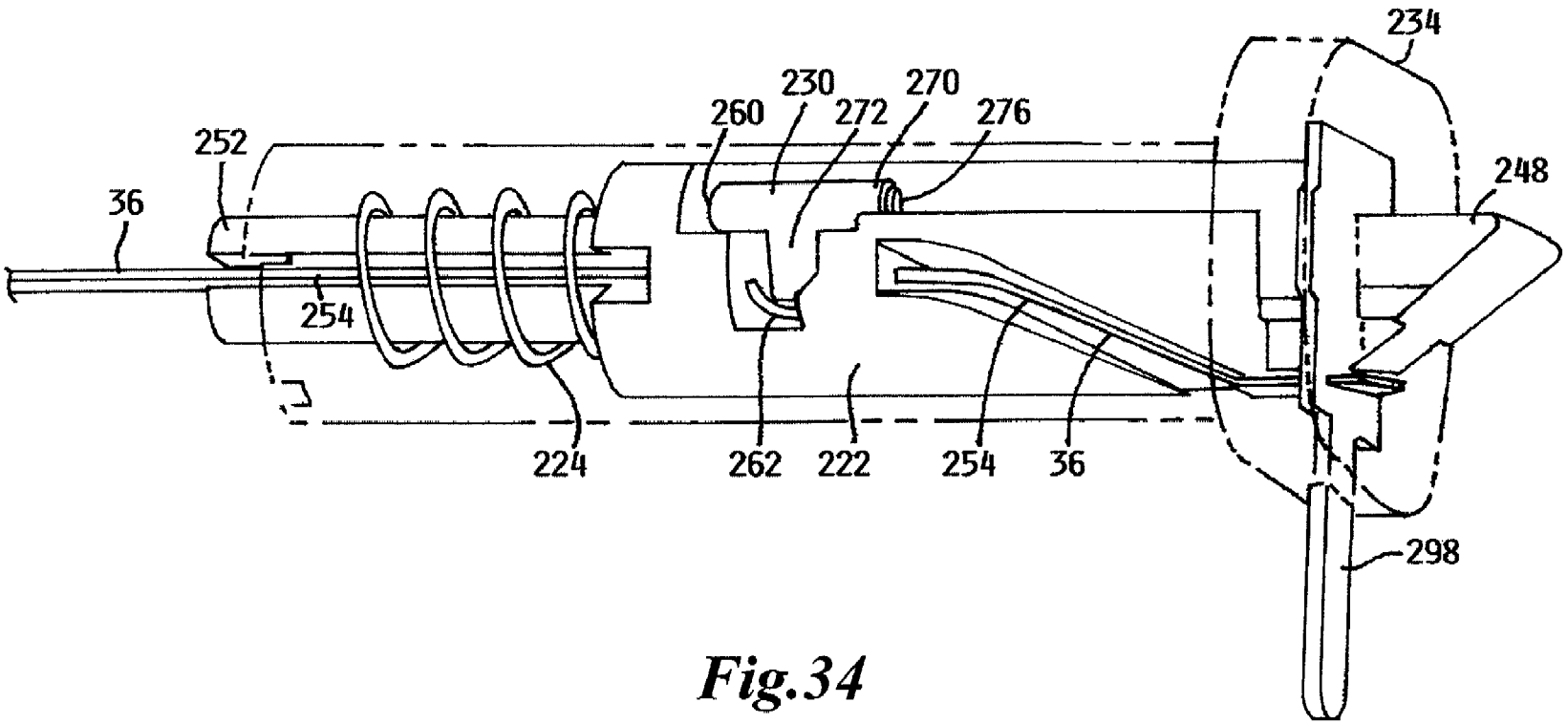
FIG. 34 depicts the tilt-latch assembly of FIG. 33 with the locking cam member positioned to lock the linking member to the plunger.
Figure 35:
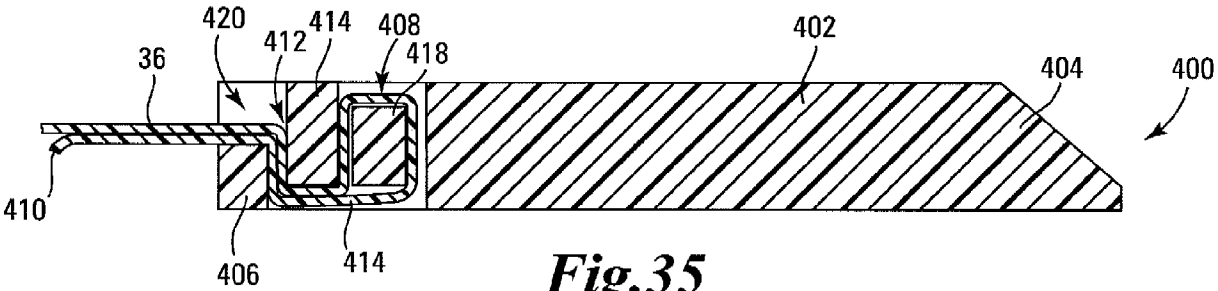
FIG. 35 is a cross-sectional view of a plunger showing how a linking member is terminally attached according to an alternative embodiment of the invention.
Figure 36:
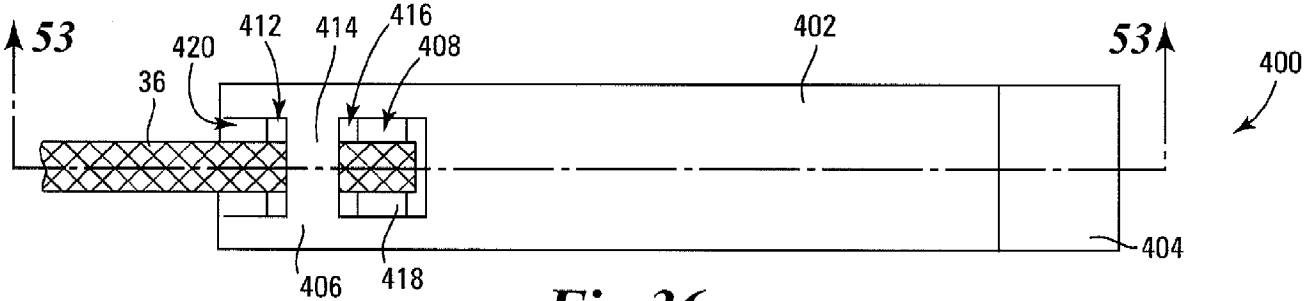
FIG. 36 is a top view of the plunger depicted in FIG. 35.
Figure 37:
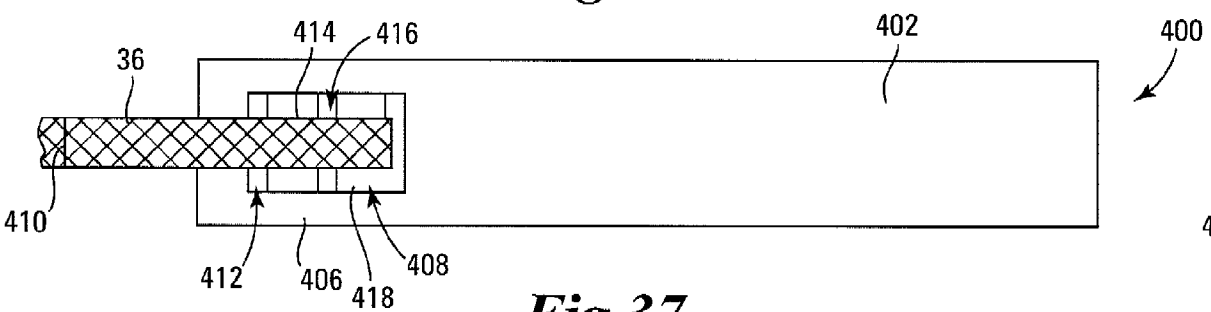
FIG. 37 is a bottom view of the plunger depicted in FIG. 35.
Figure 38:
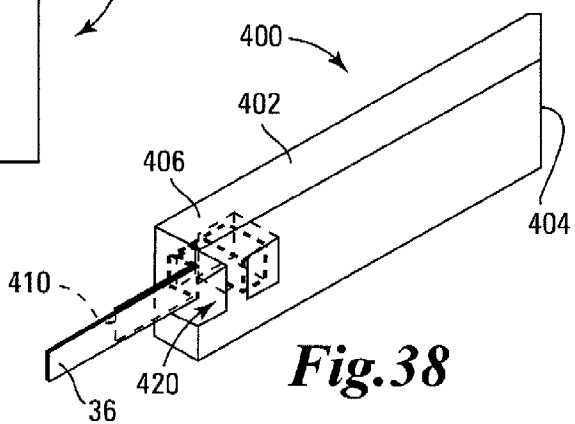
FIG. 38 is a perspective view of the plunger depicted in FIG. 35.
Figure 42:
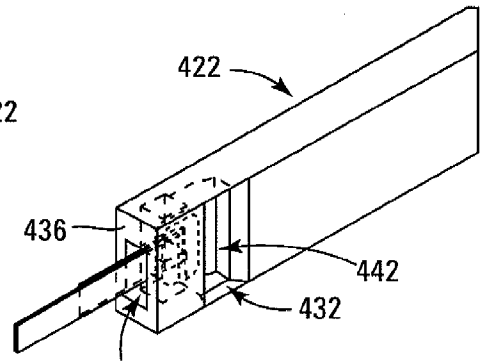
FIG. 42 is a perspective view of the plunger depicted in FIG. 39.
Figure 43:
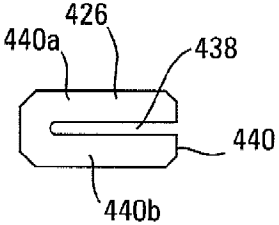
FIG. 43 is a cross-sectional view of a U-shaped component used to terminally attach a flexible linking member to the plunger depicted in FIG. 39.
Figure 39:
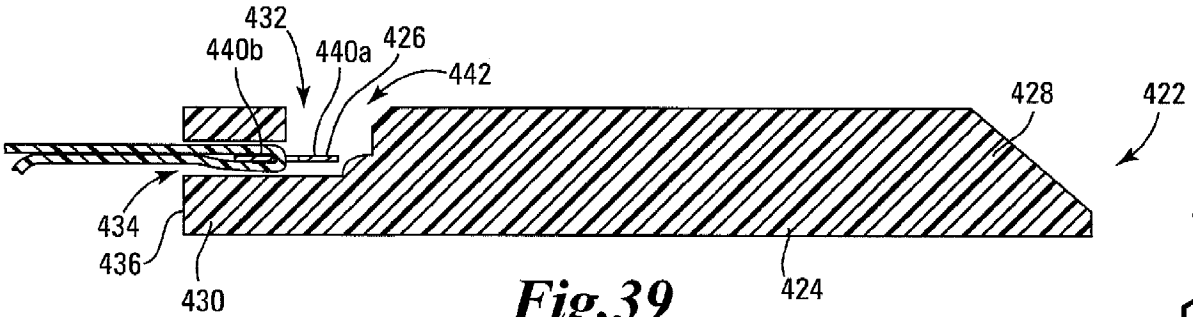
FIG. 39 is a cross-sectional view of a plunger showing how a linking member is terminally attached according to an embodiment of the invention.
Figure 40:
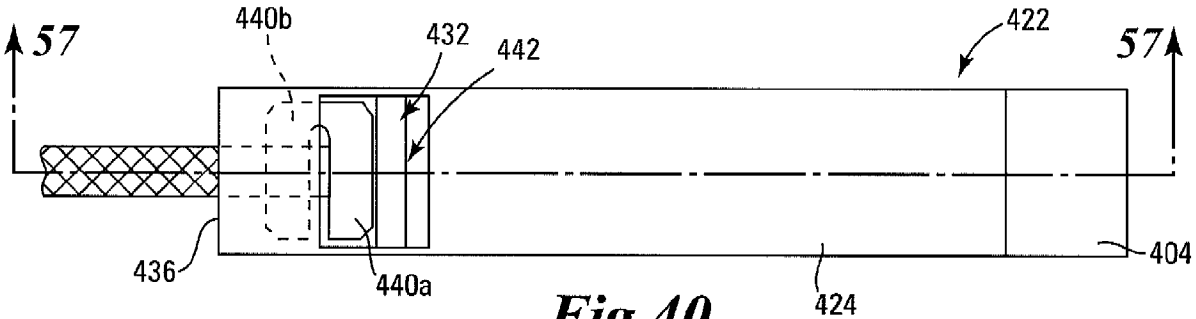
FIG. 40 is a top view of the plunger depicted in FIG. 39.
Figure 41:
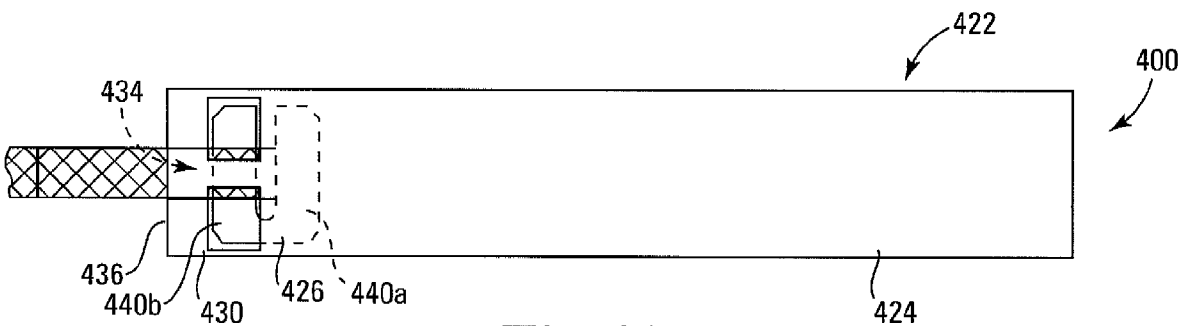
FIG. 41 is a bottom view of the plunger depicted in FIG. 39.
Figure 44:
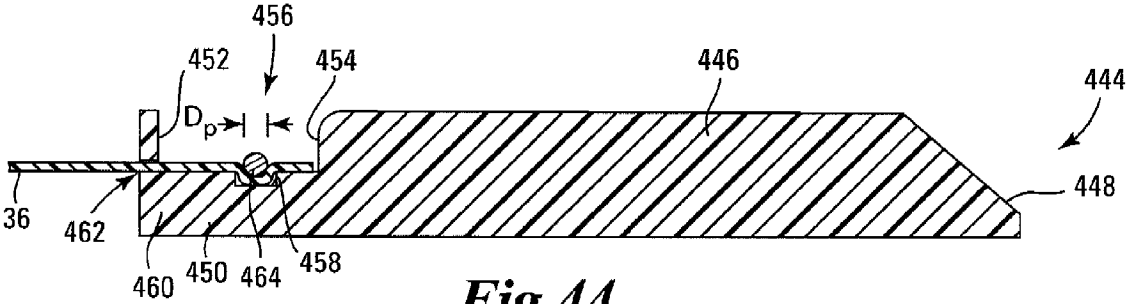
FIG. 44 is a cross-sectional view of a plunger showing how a linking member is terminally attached according to an alternative embodiment of the invention.
Figure 45:
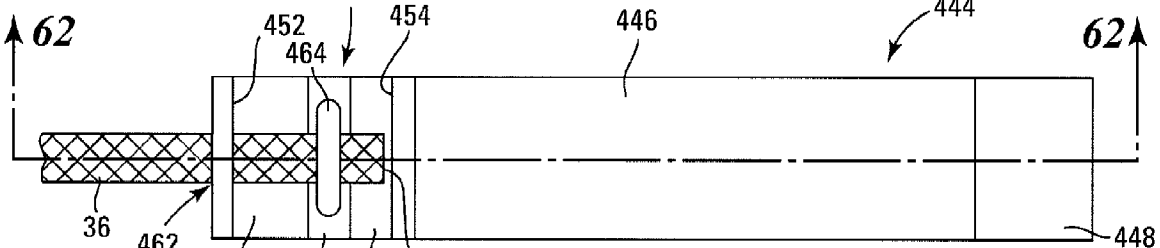
FIG. 45 is a top view of the plunger depicted in FIG. 44.
Figure 46:
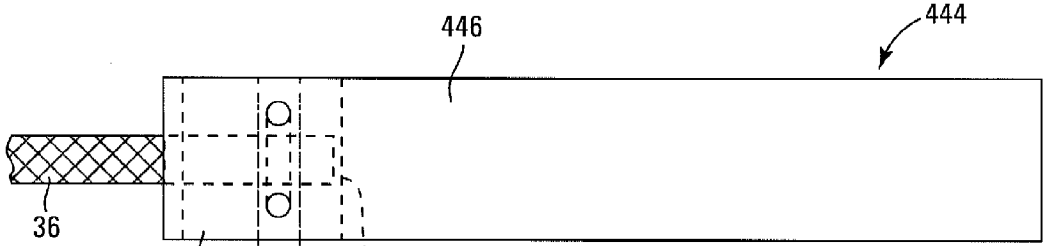
FIG. 46 is a top view of the plunger depicted in FIG. 44.
Figure 47:
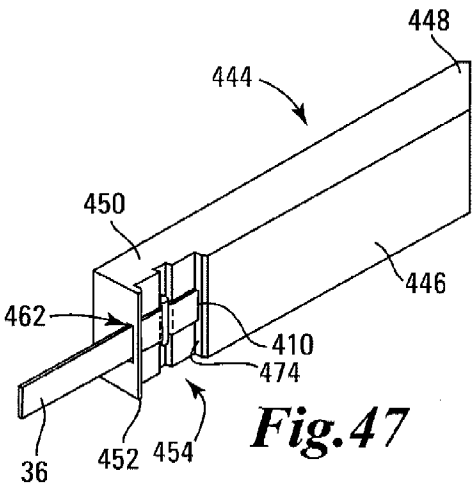
FIG. 47 is a perspective view of the plunger depicted in FIG. 44.
Figure 48:
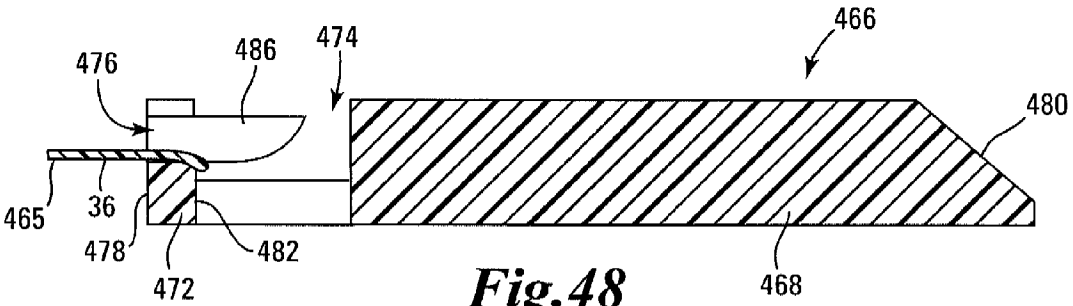
FIG. 48 is a cross-sectional view of a plunger showing how a linking member is terminally attached according to an alternative embodiment of the invention.
Figure 49:
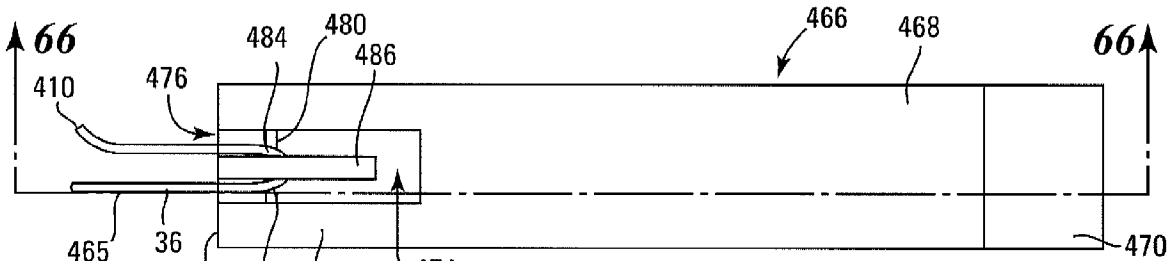
FIG. 49 is a top view of the plunger depicted in FIG. 48.
Figure 50:
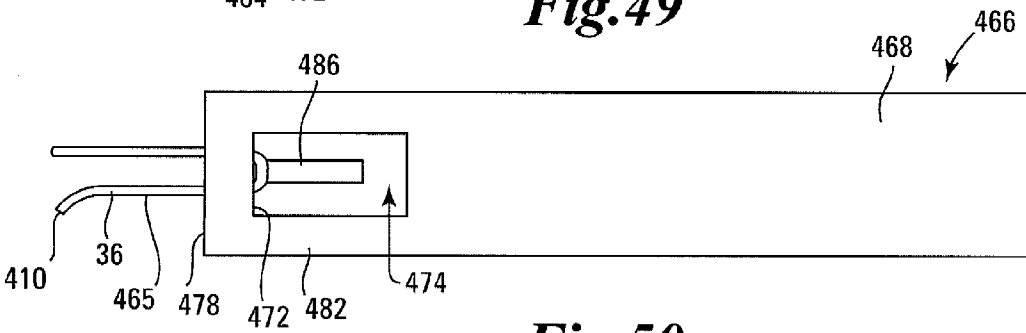
FIG. 50 is a bottom view of the plunger depicted in FIG. 48.
Figure 51:
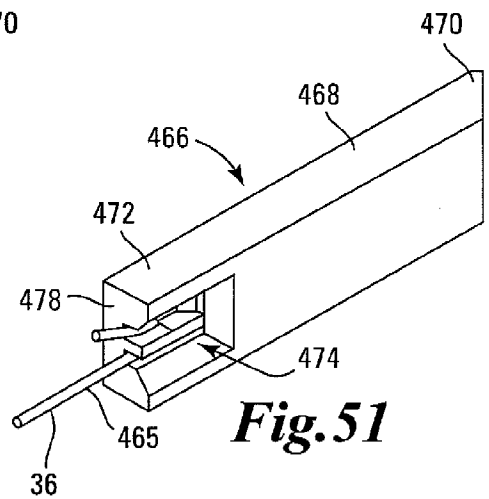
FIG. 51 is a perspective view of the plunger depicted in FIG. 48.
Figure 55:
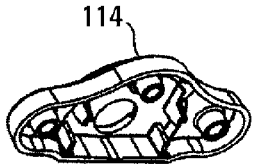
FIG. 55 is a perspective view of a base housing of a base assembly according to an embodiment of the present invention.
Figure 52:
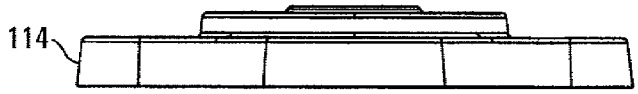
FIG. 52 is a front view of a base housing of a base assembly according to an embodiment of the present invention.
Figure 53:
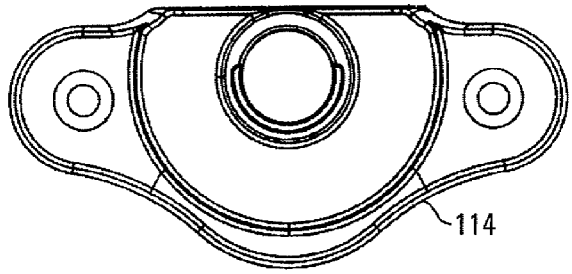
FIG. 53 is a top view of a base housing of a base assembly according to an embodiment of the present invention.
Figure 56:
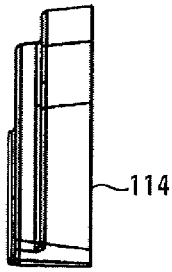
FIG. 56 is a side view of a base housing of a base assembly according to an embodiment of the present invention.
Figure 54:
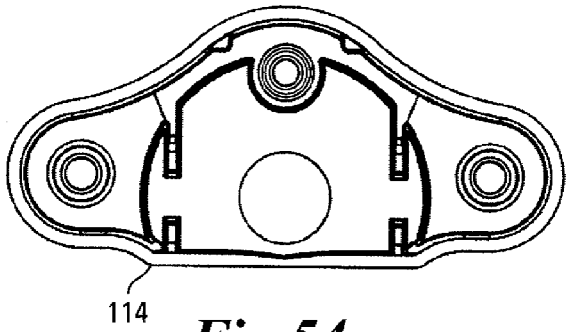
FIG. 54 is a bottom view of a base housing of a base assembly according to an embodiment of the present invention.
Figure 60:
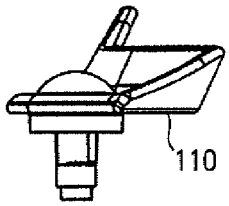
FIG. 60 is a side view of a control lever of an actuator assembly according to an embodiment of the present invention.
Figure 57:
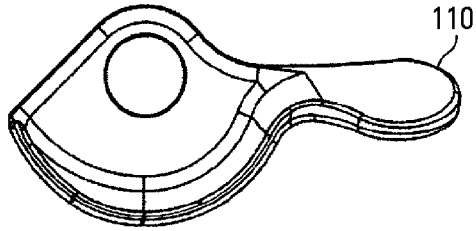
FIG. 57 is a top view of a control lever of an actuator assembly according to an embodiment of the present invention.
Figure 58:
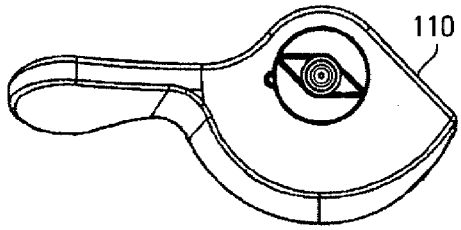
FIG. 58 is a bottom view of a control lever of an actuator assembly according to an embodiment of the present invention.
Figure 61:
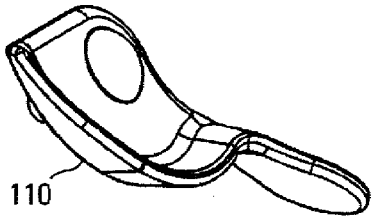
FIG. 61 is a perspective view of a control lever of an actuator assembly according to an embodiment of the present invention.
Figure 59:
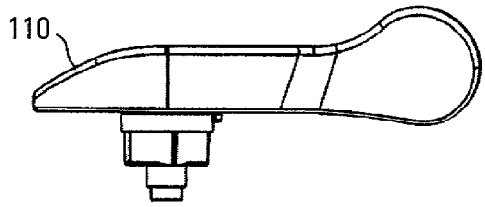
FIG. 59 is a rear view of a control lever of an actuator assembly according to an embodiment of the present invention.
Figure 62:
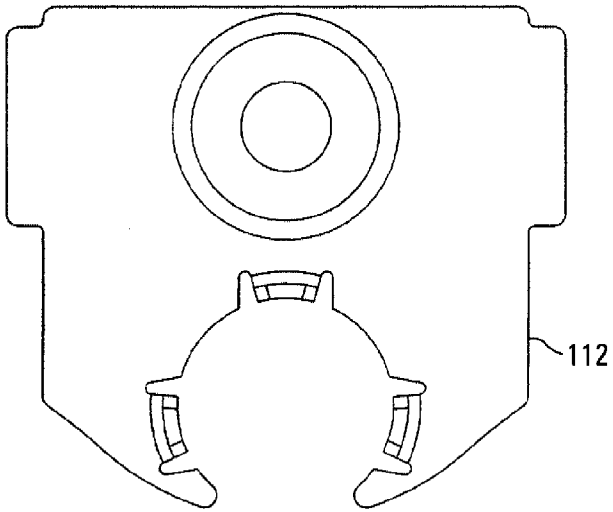
FIG. 62 is a top view of a baseplate of a base assembly according to an embodiment of the present invention.
Figure 63:
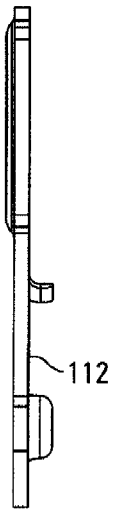
FIG. 63 is a side view of a baseplate of a base assembly according to an embodiment of the present invention.
Figure 64:
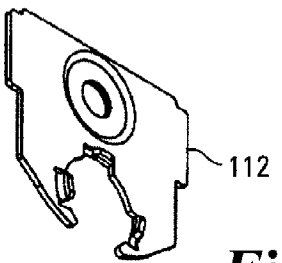
FIG. 64 is a perspective view of a baseplate of a base assembly according to an embodiment of the present invention.
Figure 67:
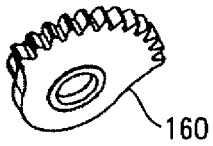
FIG. 67 is a perspective view of a gear of a base assembly according to an embodiment of the present invention.
Figure 65:
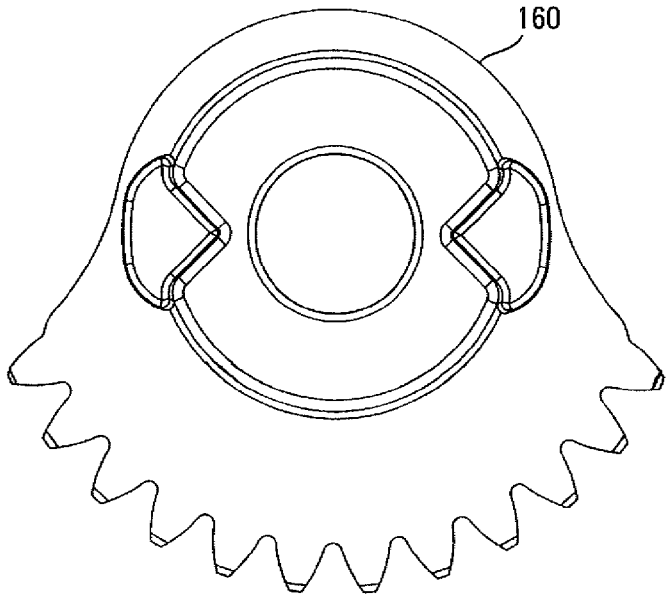
FIG. 65 is a top view of a gear of a base assembly according to an embodiment of the present invention.
Figure 68:
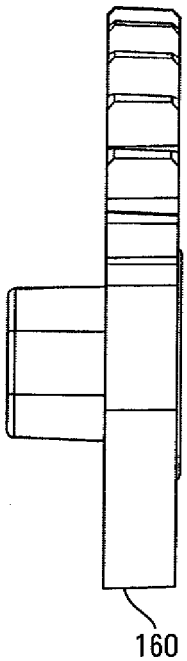
FIG. 68 is a side view of a gear of a base assembly according to an embodiment of the present invention.
Figure 66:
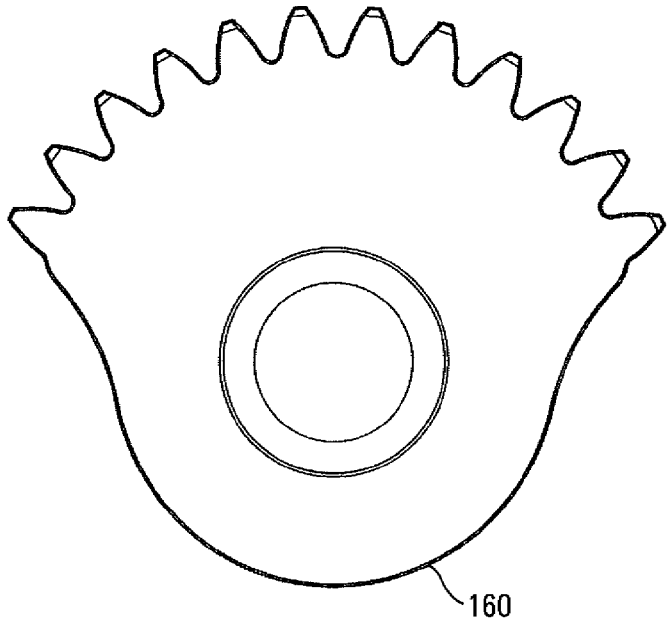
FIG. 66 is bottom view of a gear of a base assembly according to an embodiment of the present invention.
Figure 71:
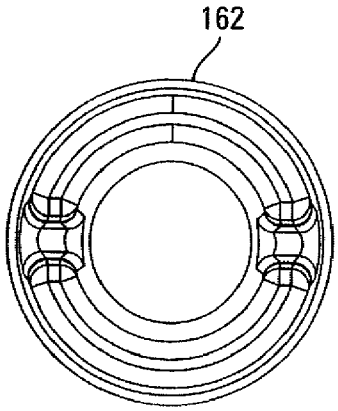
FIG. 71 is a bottom view of a spool of a base assembly according to an embodiment of the present invention.
Figure 69:
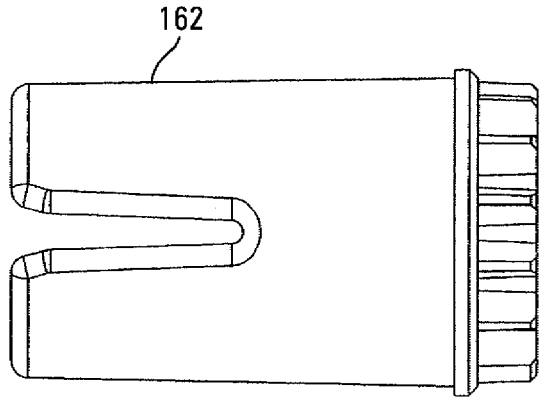
FIG. 69 is a side view of a spool of a base assembly according to an embodiment of the present invention.
Figure 72:
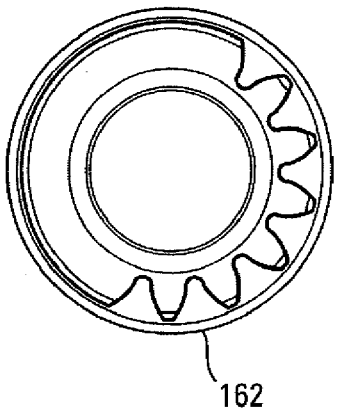
FIG. 72 is a top view of a spool of a base assembly according to an embodiment of the present invention.
Figure 70:
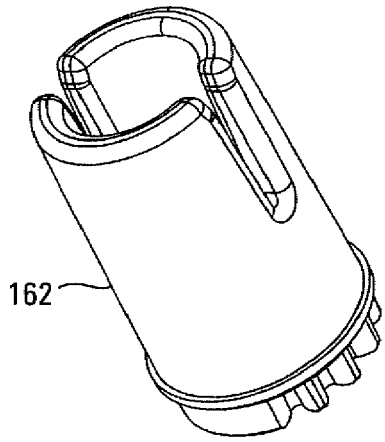
FIG. 70 is a perspective view of a spool of a base assembly according to an embodiment of the present invention.

Locking tilt-latch assembly 100 may be assembled by linking each of two tilt-latch assemblies 104 disposed in the lateral bore of the window 312 with linking member 106, and placing actuator assembly 102 in the cavity to engage linking member 106 with spool 162. Linking member 106 is preferably formed from a suitable stretch-resistant flexible polymer material. Linking member 106 is engaged with the first tilt latch assembly by inserting an Allen wrench through bore 278 and engaging hex socket 276 of locking cam 230 as depicted in FIGS. 34-35. As the Allen wrench is inserted, it forces adjustment latch arm 284 outwardly toward barrel portion 232 of housing 220, engaging tab 290 in aperture 326 to lock plunger 222 axially within housing 220 as the adjustment is made. Once engaged in hex socket 276, the Allen wrench is rotated to rotate locking cam 230 so that radial protrusion 272 is clear of channel 254. An end 328 of linking member 106 is then inserted in channel 254 at end 256 and threaded through channel 254 until it extends from housing 220 proximate latch-bolt portion 248 as depicted in FIG. 42. The Allen wrench is then rotated in the opposite direction as depicted in FIG. 43 to rotate locking cam 230 so that radial protrusion 272 forces linking member 106 into second portion 262 of lock cavity 258. In this position, linking member 106 is frictionally locked within and secured to plunger 222. The Allen wrench is then withdrawn from bore 278, enabling tab 290 to recede from aperture 326. Excess linking member 106 may then be trimmed off flush with face plate 234.

With the first tilt-latch assembly 104 disposed in, and linking member 106 extending through, lateral bore 320 and trigger portion 298 facing outer sash 327, linking member 106 may be engaged with the second tilt-latch assembly 104 by the same process as described above. With the second tilt-latch assembly 104 disposed in lateral bore 320 with trigger portion 298 facing outer sash 327, and with the Allen wrench inserted in bore 278 of the first tilt-latch assembly 104 to prevent its plunger 222 from being retracted, linking member 106 is drawn relatively taut before being locked in place and trimmed. Once linking member 106 is in place and taut, base assembly 108 of actuator assembly 102 may be dropped into cavity 314 so that spool 162 is received in lower cavity portion 318. As spool 162 enters lower cavity portion 318, chamfered edges 386 guide linking member 106 into slots 384 of spool 162 respectively. Fasteners 328 may then be driven through mounting posts 186 to secure actuator assembly 102 to top rail 308 and base assembly 108 engaged with linking member 106 to complete assembly.

In operation, with inside sash 310 and outer sash 327 in a closed position as depicted in FIG. 13, control lever 110 may be positioned in a locked position as depicted in FIGS. 15 and 17-19, wherein control lever 110 is received in keeper 122 or other structure on outer sash 327, thereby locking inside sash 310 and outer sash 327 together. Sweep cam 118 of control lever 110 is engaged in locking tab 124 of keeper 122 to provide a locked position. In the locked position, spool 162 remains aligned so that linking member 106 is not under tension and latch-bolt portions 248 of latch-bolts 34 project outwardly into grooves 332 in window frame 334, thereby preventing tilting of inside sash 310.

Window 312 may be unlocked by rotating lever 110 to an unlocked position as depicted in FIG. 20. In the unlocked position, sweep cam 118 of control lever 110 does not engage locking tab 124 of keeper 122. Once again, latch-bolts 34 are not retracted and project outwardly into grooves 332 to prevent tilting of inside sash 310. As control lever 110 and cam 158 rotate from the locked position to the unlocked position, cam 158 travels between cam followers 219 without causing gear 160 to rotate.

Generally, cam 158 is shaped and cam followers 219 are shaped and positioned so that control lever 110 has a rotational range of travel between approximately 100° and 160° degrees from the locked position to the unlocked position. In an example embodiment, control lever 110 has a range of rotation of travel of approximately 135° between the locked and unlocked positions. Between the locked and unlocked positions, biasing member 164 biases cam 158 primarily toward a locked or unlocked position. A neutral position exists in which the biasing member 164 acts upon cam 158 such that cam 158 remains substantially stationary between the locked and unlocked positions. For cam 158 to remain in the neutral position, a line between acute corners 158A,B is substantially perpendicular to flex regions 150, 152 biasing member 164. Generally, a neutral position exists at the midpoint between the locked and unlocked positions. The neutral position may, however, include any number of degrees of rotation of travel of control lever 110 between the locked and unlocked position. Generally, this neutral position is considered unfavorable and has been minimized by rounding the corners of cam 158 so as to cause cam 158 to slip past flex regions 150, 152 of biasing member 164. Between the locked position and the neutral position, biasing member 164 biases cam 158 toward the locked position.

Generally, cam 160 is shaped and cam followers 219 are shaped and positioned so that control lever 110 rotational range of travel between approximately 15° and 75° from the unlocked position to the tilt position. In an example embodiment, control lever 110 rotates approximately 45° between the unlocked and tilt positions. Between the unlocked and neutral positions, biasing member 164 biases cam 158 toward the unlocked position when rotating control lever 110 to the tilt position.

With window 312 unlocked, inside sash 310 may be tilted inward by rotating lever 110 to a tilt position as depicted in FIG. 21. As control lever 110, acute corners 158A,B of cam 158 engages gear sector 388 of spool 162 causing spool 162 to rotate, thereby applying tension to linking member 106. The tension on connecting member 106 draws plunger 222 of each tilt-latch assembly 104 inwardly toward actuator assembly 102, sliding plunger 222 within housing 220 against the bias of primary spring 224 and drawing latch-bolt portion 248 within housing 220. As leading edge 253A of latch-bolt portion 248 clears plate portion 294 of plunger-latch 226, latch spring 228 urges plunger-latch 226 in the direction of outer sash 327 so that plate portion 294 partially blocks aperture 266. Leading edge 253A of latch-bolt portion 248 engages plate portion 294, holding plunger 222 retracted within housing 220. Trigger portion 298 projects slightly from the outer face 336 of top rail 308. With control lever 110 and tilt latches 34 in tilt position, inside sash 310 may be tilted inwardly to gain access to the outside of the window. In the tilt position, biasing member 164 biases cam 158 toward the unlocked position.

Once the window cleaning or other operation is completed and it is desired to return inside sash 310 to its operable position, inside sash 310 may be simply tilted back into position. Trigger portion 298 contacts outer sash 327, urging plunger-latch 226 against the bias of latch spring 228. When plunger-latch 226 clears leading edge 253A of latch-bolt portion 248, primary spring 224 urges plunger 222 in the direction away from actuator assembly 102, so that latch-bolt portion 248 extends outwardly through aperture 266 and engages in grooves 332.

In an alternative embodiment of the present invention, top rail 308 is substantially hollow as is typically the case in vinyl window construction. Reinforcing insert 338 fits inside hollow top rail 308 to provide support for the tilt-latch assemblies 104. Housing 220 of each tilt-latch assembly 104 has spring securing tabs 340 projecting on opposite sides proximate outer end 342. Each tab 340 is resiliently attached to housing 220 at hinge line 344. Outer end 346 is normally spaced apart from housing 220, but is capable of being pressed inwardly into opening 348 in barrel portion 232 Lip 349 extends outwardly around perimeter 349A of end wall 349B. Housing 220 further has opposing flats 350, 352. Flat 350 has longitudinal ridge 354 defined thereon.

Tilt-latch assembly 104 is received through apertures 356 in top rail 308 and inside reinforcing insert 338. Insert 338 is preferably made from metal, but may also be made from any other suitably rigid and durable material. Flats 350, 352, mate with inside walls 358, 360, of reinforcing insert 338 respectively to inhibit undesired rotation of tilt-latch assembly 104 about its longitudinal axis. Longitudinal ridge 354 mates with corresponding groove 362 in inside wall 358 so that tilt-latch assembly 104 is coded for proper orientation. As each tilt-latch assembly 104 is advanced into aperture 356, tab 340 contacts edge 364, forcing outer end 346 inwardly. Once outer end 346 clears edge 364 and lip 349 contacts outer surface 366 of top rail 308, outer end 346 springs outwardly to engage inner surface (not depicted) of top rail 308 to retain tilt-latch assembly 104 in place.

As depicted in FIG. 15, optional keeper 122 generally includes locking tab 124 defining a finished outer surface 124A and skirt portion 124B. Skirt portion 124B defines recess 124C for receiving outer wall 118A of sweep cam 118. Skirt portion 124B engages circumferential recess 118B of sweep cam 118 when sweep cam 118 is rotated to the "locked" position. Openings 122A may be defined in skirt portion 124B for receiving fasteners (not depicted) to secure keeper 122 to bottom rail 378 of outer sash 327 at a location adjacent actuator assembly 102 when bottom rail 378 is adjacent top rail 308 of inside sash 310.

What is claimed is:

1. An integrated lock and tilt-latch mechanism for a sliding window, the window including a frame with a sliding sash therein, the sash tiltably positionable relative to the frame, the mechanism comprising:

a tilt latch adapted for mounting on the sash, the tilt latch having a tilt-latch housing and a plunger;

a flexible linking member operably coupled with the plunger of the tilt latch; and an actuator mechanism adapted for mounting on the sash, the actuator mechanism having a tilt-latch actuator member and a biasing member that are operably coupled to a control lever, wherein the control lever comprises a shaft operably connected to a cam and a gear, and wherein the tilt-latch actuator member has a gear sector selectively engageable with the gear to enable rotation of the tilt-latch actuator member, the flexible linking member operably engaged with the tilt latch actuator member; wherein:

the tilt-latch actuator member has an axis of rotation offset from an axis of rotation of the control lever;

the control lever is selectively positionable between a locked position in which the sliding sash is substantially immovable relative to the frame, an unlocked position in which the sliding sash is liftable relative to the frame, and a tilt position in which the sliding sash is tiltable relative to the frame, the unlocked position being intermediate the locked position and the tilt position; and the biasing member is adapted to urge the control lever to the unlocked position through a first rotational range of travel of the control lever extending from the tilt position toward the unlocked position, and to urge the control lever to the unlocked position through a second rotational range of travel extending from a point intermediate the locked position and the unlocked position toward the unlocked position.

2. The mechanism of claim 1, wherein the first rotational range of travel is at least five degrees proximate to the unlocked position and the second rotational range of travel is at least five degrees proximate to the unlocked position.

3. The mechanism of claim 2, wherein the first rotational range of travel is between five degrees and about sixty-five degrees proximate to the unlocked position, and wherein the second rotational range of travel is between five degrees and about sixty-five degrees proximate to the unlocked position.

4. The mechanism of claim 1, wherein the biasing member is further adapted to urge the control lever to the locked position through a third rotational range of travel of the control lever.

5. The mechanism of claim 4, wherein the third rotational range of travel is at least five degrees proximate to the locked position.

6. The mechanism of claim 5, wherein the third rotational range of travel is between five degrees and about sixty-five degrees proximate to the locked position.

7. The mechanism of claim 1, wherein the tilt-latch actuator member receives but does not apply tension to the flexible linking member in the unlocked position.

8. The mechanism of claim 1, wherein the tilt-latch actuator member receives but does not apply tension to the flexible linking member in the locked position.

9. The mechanism of claim 1, wherein the tilt-latch actuator member receives and applies tension to the flexible linking member when the control lever is positioned intermediate the unlocked position and the tilt position.

10. The mechanism of claim 1, wherein the control lever comprises a rotatable lever.

11. The mechanism of claim 1, wherein the control lever comprises a rotatable sweep cam.

12. The mechanism of claim 1, wherein the biasing member comprises a first biasing arm and a second biasing arm and the mechanism further comprises a first cam follower and a second cam follower, the first cam follower, the second cam follower, and the cam being positioned between the first biasing arm and the second biasing arm.

13. The mechanism of claim 12, wherein the cam is freely rotatable in a first direction between the first and second cam followers and engages the first and second cam followers in a second direction.

14. An integrated lock and tilt-latch mechanism for a sliding window, the window including a frame with a sliding sash therein, the sash tiltably positionable relative to the frame, the mechanism comprising:

a pair of tilt latches adapted for mounting on the sash, each tilt latch having a tilt-latch housing and a plunger;

a flexible linking member coupled with the plunger of each tilt latch; and an actuator mechanism adapted for mounting on the sash, the actuator mechanism having a tilt-latch actuator member operably engaged with the flexible linking member and operably coupled to a control lever, the control lever comprising a shaft operably connected to a cam and a gear, and wherein the tilt-latch actuator member has a gear sector selectively engageable with the gear to enable rotation of the tilt-latch actuator member, the control lever selectively positionable between a locked position in which the sliding sash is substantially immovable relative to the frame, an unlocked position in which the sliding sash is liftable relative to the frame, and a tilt position in which the sliding sash is tiltable relative to the frame, the unlocked position being intermediate the locked position and the tilt position, the actuator mechanism also having a biasing member for urging the control lever to an unlocked position through a first rotational range of travel of the control lever extending from the tilt position toward the unlocked position, and for urging the control lever to the unlocked position through a second rotational range of travel extending from a point intermediate the locked position and the unlocked position toward the unlocked position.

15. An integrated lock and tilt-latch mechanism for a sliding window, the window including a frame with a sliding sash therein, the sash tiltably positionable relative to the frame, the mechanism comprising:

a tilt latch adapted for mounting on the sash, the tilt latch having a tilt-latch housing and a plunger;

an actuator mechanism adapted for mounting on the sash, the actuator mechanism having a spring and a gear operably connected to a control lever and a spool defining a slot and a gear region adapted to rotationally engage the gear to enable rotation of the spool; and a flexible strap operably linking the tilt latch and the actuator mechanism, the slot of the actuator mechanism receiving the flexible strap, wherein:

the tilt-latch actuator member has an axis of rotation offset from an axis of rotation of the control lever;

the control lever is selectively positionable between a locked position in which the sliding sash is substantially immovable relative to the frame, an unlocked position in which the sliding sash is liftable relative to the frame, and a tilt position in which the sliding sash is tiltable relative to the frame, the unlocked position being intermediate the locked position and the tilt position; and the spring is adapted to urge the control lever to the unlocked position through a first rotational range of travel of the control lever extending from the tilt position toward the unlocked position, and to urge the control lever to the unlocked position through a second rotational range of travel extending from a point intermediate the locked position and the unlocked position toward the unlocked position.

* * * * *